US008863815B2

(12) United States Patent
Jansen et al.

(10) Patent No.: US 8,863,815 B2
(45) Date of Patent: Oct. 21, 2014

(54) TRACK AND GUIDE SYSTEM FOR A DOOR

(75) Inventors: Tom Jansen, Dubuque, IA (US); Peter S. Schulte, East Dubuque, IL (US); Carl David Hardison, III, Preston, IA (US); Jason Dondlinger, Bellevue, IA (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 0 days.

(21) Appl. No.: 12/769,359

(22) Filed: Apr. 28, 2010

(65) Prior Publication Data

US 2010/0263286 A1 Oct. 21, 2010

Related U.S. Application Data

(63) Continuation of application No. 11/627,281, filed on Jan. 25, 2007, now Pat. No. 7,748,431, which is a continuation-in-part of application No. 11/531,687, filed on Sep. 13, 2006, now abandoned, which is a continuation-in-part of application No. 11/446,679, filed on Jun. 5, 2006, now Pat. No. 8,037,921.

(51) Int. Cl.
*E06B 9/56* (2006.01)

(52) U.S. Cl.
USPC ..... 160/268.1; 160/264; 160/271; 160/273.1

(58) Field of Classification Search
USPC ..... 160/268.1, 264, 37, 36, 271, 273.1, 160/201, 310; 474/144, 154
See application file for complete search history.

(56) References Cited

U.S. PATENT DOCUMENTS 520,089 A 5/1894 Spaulding
647,347 A 4/1900 Wellman et al.
1,201,916 A 10/1916 Back, Jr.
1,612,261 A 12/1926 Burns
1,677,230 A 7/1928 Mercurio (Continued)

FOREIGN PATENT DOCUMENTS

CH 192088 10/1937
CH 445088 10/1967

(Continued)

OTHER PUBLICATIONS

International Searching Authority, "International Search Report," issued in connection with international application serial No. PCT/US2007/068366, mailed Dec. 17, 2010, 6 pages.

(Continued)

*Primary Examiner* — Blair M. Johnson
(74) *Attorney, Agent, or Firm* — Hanley. Flight and Zimmerman, LLC

(57) ABSTRACT

A vertically operating door and its drive system can be configured to push a door panel along a track to various overhead storage configurations including vertical, horizontal, inclined and coiled. Semi-flexible drive strips extend continuously along lateral edges of the curtain. The system includes a drive gear that engages a series of projections on at least one drive strip so that the gear can push the door between its open and closed positions. To protect the door from being damaged by collisions, the track can include a breakaway feature that allows at least a portion of the panel with its drive strip to separate from the track without permanent distortion. The drive strip and panel remain together as they break away from the track. The threshold of the breakaway force can be changed by selecting a retention strip from a plurality of interchangeable strips having different degrees of flexibility.

12 Claims, 26 Drawing Sheets

(56) References Cited

U.S. PATENT DOCUMENTS

| | | | |
|---|---|---|---|
| 1,692,206 | A | 11/1928 | Griffiths |
| 1,694,314 | A | 12/1928 | Dixson |
| 1,736,432 | A | 11/1929 | Dixson |
| 1,786,054 | A | 12/1930 | Dixson |
| 1,825,198 | A | 9/1931 | Negrini |
| 1,840,454 | A | 1/1932 | Kennedy |
| RE18,716 | E | 1/1933 | Dixson |
| 1,933,709 | A | 11/1933 | Cooper |
| 2,173,900 | A | 9/1939 | Dunn |
| 2,188,509 | A | 1/1940 | Kavanagh et al. |
| 2,211,491 | A | 8/1940 | Brooke |
| 2,349,226 | A | 5/1944 | Thomas |
| 2,406,272 | A | 8/1946 | Van Voorhees |
| 2,424,055 | A | 7/1947 | Rousseau |
| 2,610,681 | A | 9/1952 | Schaap |
| 2,877,886 | A | 3/1959 | Braid |
| 3,007,342 | A | 11/1961 | Wardlaw |
| 3,017,218 | A | 1/1962 | Groth et al. |
| 3,017,927 | A | 1/1962 | Demko |
| 3,025,532 | A | 3/1962 | Skuda |
| 3,092,170 | A | 6/1963 | Ellis |
| 3,115,182 | A | 12/1963 | Bobbitt |
| 3,116,097 | A | 12/1963 | Novales |
| 3,142,333 | A | 7/1964 | Kummerman et al. |
| 3,149,665 | A | 9/1964 | Handford |
| 3,237,682 | A | 3/1966 | Davis |
| 3,430,677 | A | 3/1969 | Pierce |
| 3,512,302 | A | 5/1970 | Sivin et al. |
| 3,516,469 | A | 6/1970 | McDonald |
| 3,878,879 | A | 4/1975 | Manns |
| 3,981,343 | A | 9/1976 | DeVito |
| 4,164,338 | A | 8/1979 | Myron |
| 4,175,608 | A | 11/1979 | Alten |
| 4,199,019 | A | 4/1980 | Frei |
| 4,237,956 | A | 12/1980 | Sivin et al. |
| 4,357,978 | A | 11/1982 | Keller et al. |
| 4,398,585 | A | 8/1983 | Marlow |
| 4,402,642 | A | 9/1983 | Klancnik et al. |
| 4,478,268 | A | 10/1984 | Palmer et al. |
| 4,563,034 | A | 1/1986 | Lamb |
| 4,586,552 | A | 5/1986 | Labelle |
| 4,601,320 | A | 7/1986 | Taylor |
| 4,610,293 | A | 9/1986 | Weiblen |
| 4,649,981 | A | 3/1987 | Bibeau |
| 4,656,780 | A | 4/1987 | Miyauchi et al. |
| 4,667,724 | A | 5/1987 | Dragone |
| 4,690,195 | A | 9/1987 | Taylor |
| 4,707,017 | A | 11/1987 | Minobe et al. |
| 4,723,588 | A | 2/1988 | Riippel |
| 4,811,777 | A | 3/1989 | Chretien |
| 4,815,515 | A | 3/1989 | Lee |
| 4,825,921 | A | 5/1989 | Rigter |
| 4,878,528 | A | 11/1989 | Kobayashi |
| 4,884,617 | A | 12/1989 | Coenraets |
| 4,947,937 | A | 8/1990 | Searer et al. |
| 4,966,217 | A | 10/1990 | Dechambeau et al. |
| 4,966,219 | A | 10/1990 | Sonolet |
| 4,986,331 | A | 1/1991 | Henkenjohann |
| 5,042,556 | A | 8/1991 | Ruiter |
| 5,048,739 | A | 9/1991 | Unuma et al. |
| 5,054,605 | A | 10/1991 | Bavis |
| 5,058,651 | A | 10/1991 | Ashley et al. |
| 5,072,767 | A | 12/1991 | Kraeutler |
| 5,117,893 | A | 6/1992 | Morrison et al. |
| 5,123,474 | A | 6/1992 | Smith |
| 5,131,450 | A | 7/1992 | Lichy |
| 5,163,495 | A | 11/1992 | Lichy |
| 5,170,833 | A | 12/1992 | Taylor et al. |
| 5,176,194 | A | 1/1993 | Chigusa |
| 5,219,015 | A | 6/1993 | Kraeutler |
| 5,232,408 | A | 8/1993 | Brown |
| 5,233,185 | A | 8/1993 | Whitaker |
| 5,307,859 | A | 5/1994 | Kraeutler |
| 5,353,858 | A | 10/1994 | Hartmann |
| 5,372,173 | A | 12/1994 | Horner |
| 5,392,836 | A | 2/1995 | West et al. |
| 5,443,563 | A | 8/1995 | Hindel et al. |
| 5,445,209 | A | 8/1995 | Lichy |
| 5,482,104 | A | 1/1996 | Lichy |
| 5,484,007 | A | 1/1996 | Rejc |
| 5,488,982 | A | 2/1996 | Rejc |
| 5,526,865 | A | 6/1996 | Coenraets |
| 5,544,690 | A | 8/1996 | Magro et al. |
| 5,586,592 | A | 12/1996 | McGregor |
| 5,611,497 | A | 3/1997 | Krambeck et al. |
| 5,651,406 | A | 7/1997 | Schaap |
| 5,682,937 | A | 11/1997 | Decrane et al. |
| 5,722,476 | A | 3/1998 | Lujan-Sanchez et al. |
| 5,758,705 | A | 6/1998 | Wagner et al. |
| 5,839,493 | A | 11/1998 | Quasius |
| 5,848,631 | A | 12/1998 | DeGiovanni et al. |
| 5,901,770 | A | 5/1999 | Belpaume et al. |
| 5,927,690 | A | 7/1999 | White et al. |
| 5,964,270 | A | 10/1999 | Kirkey et al. |
| 6,041,843 | A | 3/2000 | Mullet |
| 6,065,525 | A | 5/2000 | Wells |
| 6,119,758 | A | 9/2000 | Coenraets |
| 6,152,208 | A | 11/2000 | Kalempa et al. |
| 6,243,006 | B1 | 6/2001 | Rejc et al. |
| 6,257,305 | B1 | 7/2001 | Mullet et al. |
| 6,296,039 | B1 | 10/2001 | Mullet et al. |
| 6,341,639 | B1 | 1/2002 | Mullet et al. |
| 6,431,250 | B2 | 8/2002 | Mullet et al. |
| 6,439,292 | B1 | 8/2002 | Schutte et al. |
| 6,492,003 | B1 | 12/2002 | Ochiai et al. |
| 6,631,749 | B1 | 10/2003 | Zabala |
| 6,715,531 | B2 | 4/2004 | Simon |
| 6,729,378 | B2 | 5/2004 | Simon et al. |
| 6,848,734 | B1 | 2/2005 | Mulvaney |
| 6,851,464 | B2 | 2/2005 | Hudoba et al. |
| 6,942,003 | B2 | 9/2005 | Thompson |
| 7,028,741 | B2 | 4/2006 | Coenraets |
| 7,036,549 | B2 | 5/2006 | Coenraets |
| 7,131,481 | B2 | 11/2006 | Varley et al. |
| 7,275,581 | B2 | 10/2007 | Coenraets |
| 7,516,770 | B2 | 4/2009 | Jerry |
| 8,037,921 | B2 | 10/2011 | Dondlinger et al. |
| 2003/0041978 | A1 | 3/2003 | Farooq |
| 2003/0213180 | A1 | 11/2003 | Ueda |
| 2004/0182024 | A1 | 9/2004 | Varley et al. |
| 2005/0211397 | A1 | 9/2005 | Coenraets |
| 2005/0211398 | A1 | 9/2005 | Coenraets |
| 2005/0269045 | A1 | 12/2005 | Rejc |
| 2006/0248819 | A1 | 11/2006 | Coenraets |
| 2007/0277941 | A1 | 12/2007 | Jansen et al. |
| 2007/0277942 | A1 | 12/2007 | Dondlinger et al. |
| 2007/0277943 | A1 | 12/2007 | Boerger et al. |
| 2008/0035282 | A1 | 2/2008 | Coenraets |

FOREIGN PATENT DOCUMENTS

| | | |
|---|---|---|
| DE | 2939834 | 4/1981 |
| DE | 3222770 | 12/1983 |
| DE | 4000908 | 7/1991 |
| DE | 10318146 | 10/2004 |
| EP | 0033199 | 8/1981 |
| EP | 0252839 | 1/1988 |
| EP | 0264220 | 4/1988 |
| EP | 0397619 | 11/1990 |
| EP | 0688936 | 12/1995 |
| EP | 0757745 | 5/2003 |
| EP | 1460231 | 9/2004 |
| FR | 1405971 | 6/1965 |
| FR | 1408464 | 7/1965 |
| FR | 1467892 | 12/1966 |
| FR | 2373663 | 7/1978 |
| FR | 2418860 | 9/1979 |
| FR | 2447450 | 8/1980 |
| FR | 2621951 | 4/1989 |
| FR | 2683258 | 7/1993 |
| FR | 2762642 | 10/1998 |
| GB | 1545508 | 5/1979 |
| GB | 2196370 | 4/1988 |
| JP | 2002201876 | 7/2002 |

(56) References Cited

FOREIGN PATENT DOCUMENTS

| | | |
|---|---|---|
| JP | 2004257071 | 9/2004 |
| WO | 8807122 | 9/1988 |
| WO | 8807618 | 10/1988 |
| WO | 0194735 | 12/2001 |
| WO | 0215755 | 2/2002 |
| WO | 03048497 | 6/2003 |
| WO | 03106805 | 12/2003 |
| WO | 2005090704 | 9/2005 |
| WO | 2006120655 | 11/2006 |
| WO | 2007146510 | 12/2007 |

OTHER PUBLICATIONS

International Searching Authority, "Written Opinion of the International Searching Authority," issued in connection with international application serial No. PCT/US2007/068366, mailed Dec. 17, 2010, 13 pages.
International Bureau, "International Preliminary Report on Patentability," issued in connection with international application serial No. PCT/US2007/068366, issued Dec. 21, 2010, mailed Jan. 6, 2011, 14 pages.
United States Patent and Trademark Office, "Notice of Allowance," issued in connection with U.S. Appl. No. 11/446,679, mailed Jun. 13, 2011, 15 pages.
United States Patent and Trademark Office, "Final Office Action," issued in connection with U.S. Appl. No. 11/531,687, mailed Jun. 8, 2011, 12 pages.
Canadian Intellectual Property Office, "Notice of Allowance," issued in connection with Canadian application serial No. 2,654,518, issued May 17, 2011, 2 pages.
United States Patent and Trademark Office, "Notice of Allowance," issued in connection with U.S. Appl. No. 11/446,679, mailed Apr. 16, 2010, 15 pages.
United States Patent and Trademark Office, "Final Office Action," issued in connection with U.S. Appl. No. 11/446,679, mailed Dec. 2, 2009, 20 pages.
United States Patent and Trademark Office, "Non-Final Office Action," issued in connection with U.S. Appl. No. 11/446,679, mailed Jun. 19, 2009, 11 pages.
United States Patent and Trademark Office, "Final Office Action," issued in connection with U.S. Appl. No. 11/446,679, mailed Dec. 24, 2008, 21 pages.
United States Patent and Trademark Office, "Non-Final Office Action," issued in connection with U.S. Appl. No. 11/446,679, mailed May 14, 2008, 10 pages.
United States Patent and Trademark Office, "Final Office Action," issued in connection with U.S. Appl. No. 11/531,687, mailed Dec. 7, 2009, 15 pages.
United States Patent and Trademark Office, "Non-Final Office Action," issued in connection with U.S. Appl. No. 11/531,687, mailed Jun. 15, 2009, 10 pages.
United States Patent and Trademark Office, "Final Office Action," issued in connection with U.S. Appl. No. 11/531,687, mailed Dec. 19, 2008, 11 pages.
United States Patent and Trademark Office, "Non-Final Office Action," issued in connection with U.S. Appl. No. 11/531,687, mailed May 14, 2008, 11 pages.
United States Patent and Trademark Office, "Supplemental Notice of Allowance," issued in connection with U.S. Appl. No. 11/627,281, mailed Mar. 17, 2010, 5 pages.
United States Patent and Trademark Office, "Supplemental Notice of Allowance," issued in connection with U.S. Appl. No. 11/627,281, mailed Mar. 11, 2010, 5 pages.
United States Patent and Trademark Office, "Notice of Allowance," issued in connection with U.S. Appl. No. 11/627,281, mailed Feb. 26, 2010, 11 pages.
United States Patent and Trademark Office, "Corrected Notice of Allowance," issued in connection with U.S. Appl. No. 11/627,281, mailed Dec. 24, 2009, 8 pages.
United States Patent and Trademark Office, "Notice of Allowance," issued in connection with U.S. Appl. No. 11/627,281, mailed Dec. 15, 2009, 11 pages.
United States Patent and Trademark Office, "Non-Final Office Action," issued in connection with U.S. Appl. No. 11/627,281, mailed Apr. 27, 2009, 16 pages.
United States Patent and Trademark Office, "Notice of Allowance," issued in connection with U.S. Appl. No. 11/627,281, mailed Sep. 22, 2008, 16 pages.
United States Patent and Trademark Office, "Notice of Allowance," issued in connection with U.S. Appl. No. 11/627,281, mailed May 16, 2008, 12 pages.
United States Patent and Trademark Office, "Advisory Action," issued in connection with U.S. Appl. No. 11/531,687, mailed Apr. 23, 2010, 3 pages.
United States Patent and Trademark Office, "Interview Summary," issued in connection with U.S. Appl. No. 11/531,687, mailed Apr. 6, 2010, 3 pages.
United States Patent and Trademark Office, "Notice of Allowance," issued in connection with U.S. Appl. No. 11/627,281, mailed Mar. 11, 2009, 15 pages.
United States Patent and Trademark Office, "Interview Summary," issued in connection with U.S. Appl. No. 11/446,679, mailed Apr. 6, 2010, 3 pages.
United States Patent and Trademark Office, "Non-Final Office Action," issued in connection with U.S. Appl. No. 11/531,687, mailed May 26, 2010, 15 pages.
United States Patent and Trademark Office, "Supplemental Notice of Allowance," issued in connection with U.S. Appl. No. 11/446,679, mailed Jun. 25, 2010, 4 pages.
United States Patent and Trademark Office, "Supplemental Notice of Allowance," issued in connection with U.S. Appl. No. 11/446,679, mailed Jun. 14, 2010, 2 pages.
United States Patent and Trademark Office, "Supplemental Notice of Allowance," issued in connection with U.S. Appl. No. 11/446,679, mailed May 24, 2010, 4 pages.
United States Patent and Trademark Office, "Supplemental Notice of Allowance," issued in connection with U.S. Appl. No. 11/627,281, mailed May 21, 2010, 4 pages.
Canadian Patent Office, "Office Communication," issued in connection with Canadian application serial No. 2,654,518, issued Jul. 22, 2010, 3 pages.
International Searching Authority, "Invitation to Pay Fees and Partial Search Report," issued in connection with international application serial No. PCT/US2007/068366, mailed Jul. 23, 2010, 11 pages.
United States Patent and Trademark Office, "Non-Final Office Action," issued in connection with U.S. Appl. No. 11/446,679, mailed Oct. 18, 2010, 12 pages.
United States Patent and Trademark Office, "Non-Final Office Action," issued in connection with U.S. Appl. No. 11/531,687, mailed Oct. 21, 2010, 9 pages.
Mexican Patent Office, "Second Office Action," issued in connection with U.S. Patent Application No. MX/a/2008/015346, mailed on Mar. 28, 2012, 5 pages.
United States Patent and Trademark Office, "Non-Final Office Action," issued in connection with U.S. Appl. No. 12/842,706, mailed on Mar. 23, 2012, 31 pages.
United States Patent and Trademark Office, "Final Office Action," issued in connection with U.S. Appl. No. 12/842,706, mailed on Jul. 31, 2012, 13 pages.
USPTO, "Advisory Action," issued in connection with U.S. Appl. No. 12/842,706, on Nov. 13, 2012 (3 pages).
IP Austalia, "Examination Report," issued in connection with Australian Patent Application No. 2007258116, dated Nov. 6, 2012 (4 pages).
USPTO, "Notice of Allowance," issued in connection with U.S. Appl. No. 12/842,706, dated Dec. 18, 2012 (8 pages).
USPTO, "Office Action," issued in connection with U.S. Appl. No. 12/842,706, dated Mar. 11, 2013 (7 pages).
USPTO, "Office Action," issued in connection with U.S. Appl. No. 12/842,706, dated Jul. 24, 2013 (8 pages).
USPTO, "Advisory Action," issued in connection with U.S. Appl. No. 12/842,706, dated Oct. 10, 2013 (4 pages).

(56) References Cited

OTHER PUBLICATIONS

United States Patent and Trademark Office, "Office Action," issued in connection with U.S. Appl. No. 12/842,706 on Nov. 7, 2013, 7 pages.
IP Australia, "Notice of Acceptance," issued in connection with Australian Patent Application No. 2007258116, dated Jan. 16, 2014, 3 pages.
IP Australia, "Certificate of Grant", issued in connection with Australian patent No. 2007258116, May 15, 2014, 1 page.
Intellectual Property Office of India, "First Examination Report," issued in connection with Indian patent application No. 9937/DELNP/2008, mailed on Apr. 28, 2014, 3 pages.
United States Patent and Trademark Office, "Notice of Allowance", issued in connection with U.S. Appl. No. 12/842,706, mailed on Jun. 11, 2014, 10 pages.

TRACK AND GUIDE SYSTEM FOR A DOOR

CROSS REFERENCE TO RELATED APPLICATION

This application is a continuation of U.S. patent application Ser. No. 11/627,281 entitled "Track and Guide System For a Door," filed Jan. 25, 2007, which is a continuation-in-part of U.S. patent application Ser. No. 11/531,687 entitled "Track and Guide System for a Door," filed Sep. 13, 2006, which is in turn a continuation-in-part of U.S. patent application Ser. No. 11/446,679 entitled "Track and Guide System for a Door," filed Jun. 5, 2006, all of which are incorporated herein by reference in their entireties.

FIELD OF THE DISCLOSURE

The present disclosure generally pertains to doors with a retractable panel and, more specifically, to a drive and/or a guide system for such a door.

BACKGROUND OF RELATED ART

Many vertically operating doors have a pliable panel or curtain that opens by moving from a vertical set of tracks installed along the lateral edges of a doorway to an overhead storage system. The storage system can vary depending on the available space above the doorway and other considerations. An overhead storage system, for instance, can be in the form of a take-up roller that draws in the curtain to open the door; or the storage system can be a set of horizontal, vertical, or inclined tracks that lead into the set of vertical tracks that line the doorway.

While the take-up roller can be power-driven to raise and lower the curtain, doors having other types of overhead storage may require some other means for operating the door. Thus, door manufactures often need to offer a selection of doors of dramatically different designs to meet the requirements of various door installation sites.

U.S. Pat. No. 7,028,741, however, discloses a door with a drive system that can force-feed a curtain into various overhead configurations. Moreover, the door includes a breakaway feature that enables the curtain to safely break away from its guide track if a forklift or something else crashes into the door.

Although the force-feed system and breakaway feature provide significant benefits, the patented door includes a complicated collection of numerous parts. In some cases (FIG. 3 of the '741 patent), the curtain is coupled to a track via a drive strip that carries a long series of individual clips that enable the curtain to breakaway from the drive strip. In the event of an impact, the curtain can break away from those clips, while the drive strip remains with the track. It appears that a complicated mechanism (FIG. 19 of the '741 patent) is subsequently used for reattaching the curtain to the clips.

In other cases (FIG. 5 of the '741 patent), the numerous clips are replaced by a drive strip that is blanked and formed to include integral clips. But even then the drive strip remains with the track after a breakaway collision, thus the door has a curtain that can move relative to a drive strip, which in turn can move relative to a track. Moreover, it appears that the drive strip with the integral clips is made of sheet metal. Such a material, particularly if it has sharp edges, might cause significant wear on the gear that moves the drive strip.

Consequently, a need exists for a vertically operating door that is simple and robust, wherein the door includes a drive unit that can push the door's curtain to various overhead storage configurations including vertical, horizontal, inclined and coiled.

SUMMARY

In some embodiments, a door with a vertically translating panel includes a drive mechanism that allows the panel to retract onto storage tracks of various shapes or configurations including, but not limited to, storage tracks that are vertical, horizontal, inclined, coiled and various unlimited combinations thereof.

In some embodiments, the door panel is provided with a continuous drive strip that has sufficient flexibility to travel along tracks of various shapes yet is sufficiently rigid to allow the drive strip, under the impetus of a drive gear, to push the door to an elevated stored position.

In some embodiments, the continuous drive strip includes a plurality of spaced projections for engaging the drive gear.

In some embodiments, the door panel breaks away from its track without creating loose pieces in the track or on the panel.

In some embodiments that allow the panel to break away, the door includes an auto-refeed device that has no moving parts.

In some embodiments that allow the panel to break away, the door includes an auto-refeed device that has movable parts, including, for example, at least one roller.

In some embodiments that allow the panel to break away, the panel can progressively break away in a zipper-like manner.

In some embodiments, a drive strip for the door panel includes spherical projections that smoothen a breakaway function and smoothen the engagement with a drive gear.

In some embodiments, at least one roller assists in the engagement of the spherical projections of the drive strip with the drive gear.

In some embodiments, at least one roller assists in the engagement of the spherical projections of the drive strip with the drive gear and concurrently reduces the friction load on the spherical projections.

In some embodiments, a continuous drive strip with projections is flexible due to thinner sections of the strip that extend between the projections.

In some embodiments, the drive strip's flexibility allows it to flex one way as it travels past a drive gear and bend an opposite way as the door panel moves onto a storage track.

In some embodiments, a track defines a chamber for housing a sensor within the track.

In some embodiments, a resilient seal member is installed inside a channel of the track such that the seal member presses against an edge of the drive strip.

In some embodiments, a storage track can hold a flexible door panel in a coiled configuration with a central region that is wide open.

In some embodiments, a storage track includes a guide to assist in the movement of the flexible door panel into and out of a coiled configuration.

In some embodiments, the guide in the storage track reduces the friction load on the edge of the flexible door panel.

In some embodiments, the flexible door panel can be opened to a coiled configuration without the need for a take-up roll tube.

In some embodiments, the flexible door panel can be opened to a loosely coiled configuration to permit ventilation through the coiled panel and/or to help prevent a plastic window on the panel from being scratched by other sections of the panel.

In some embodiments, a stiffener is attached to an upper edge of the door's panel to help prevent the upper edge from whipping centrifugally outward as the panel is wrapped into a coiled configuration.

In some embodiments, the door includes a horizontal drum that creates a bend in the panel of the door to help prevent the panel from sagging.

In some embodiments, an abrasion-resistant reinforcing edge may be added to a yieldable retention strip.

In some embodiments, the reinforcing edge may stiffen the yieldable retention strip allowing for an increased track width, while retaining door wind resistance.

In some embodiments, sound attenuation and/or improved durability is achieved by mounting a plurality of projections on a fabric drive strip, wherein the drive strip is more flexible than an adjacent reinforcing strip.

In some embodiments, a fabric drive strip and its plurality of driven projections are disposed within the door's guide track, while a flexible but yet more rigid reinforcing strip is primarily or entirely outside the track.

In some embodiments, a reinforcing strip has greater resistance to lengthwise compression than a drive strip disposed in proximity therewith.

DETAILED DESCRIPTION OF AN EXAMPLE

Figure 1:
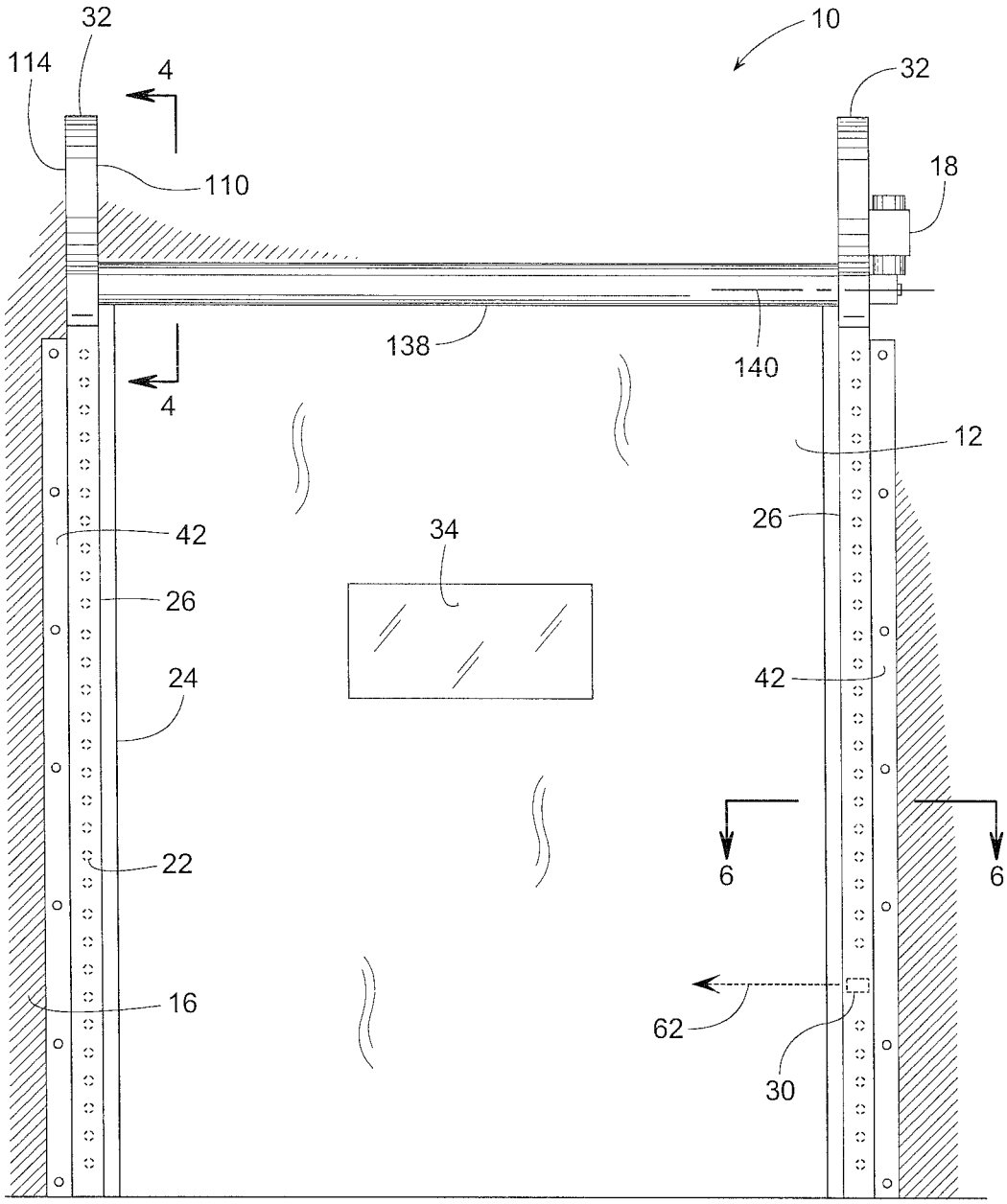
FIG. 1 is a front view of one embodiment of a door in a closed position.
Figure 2:
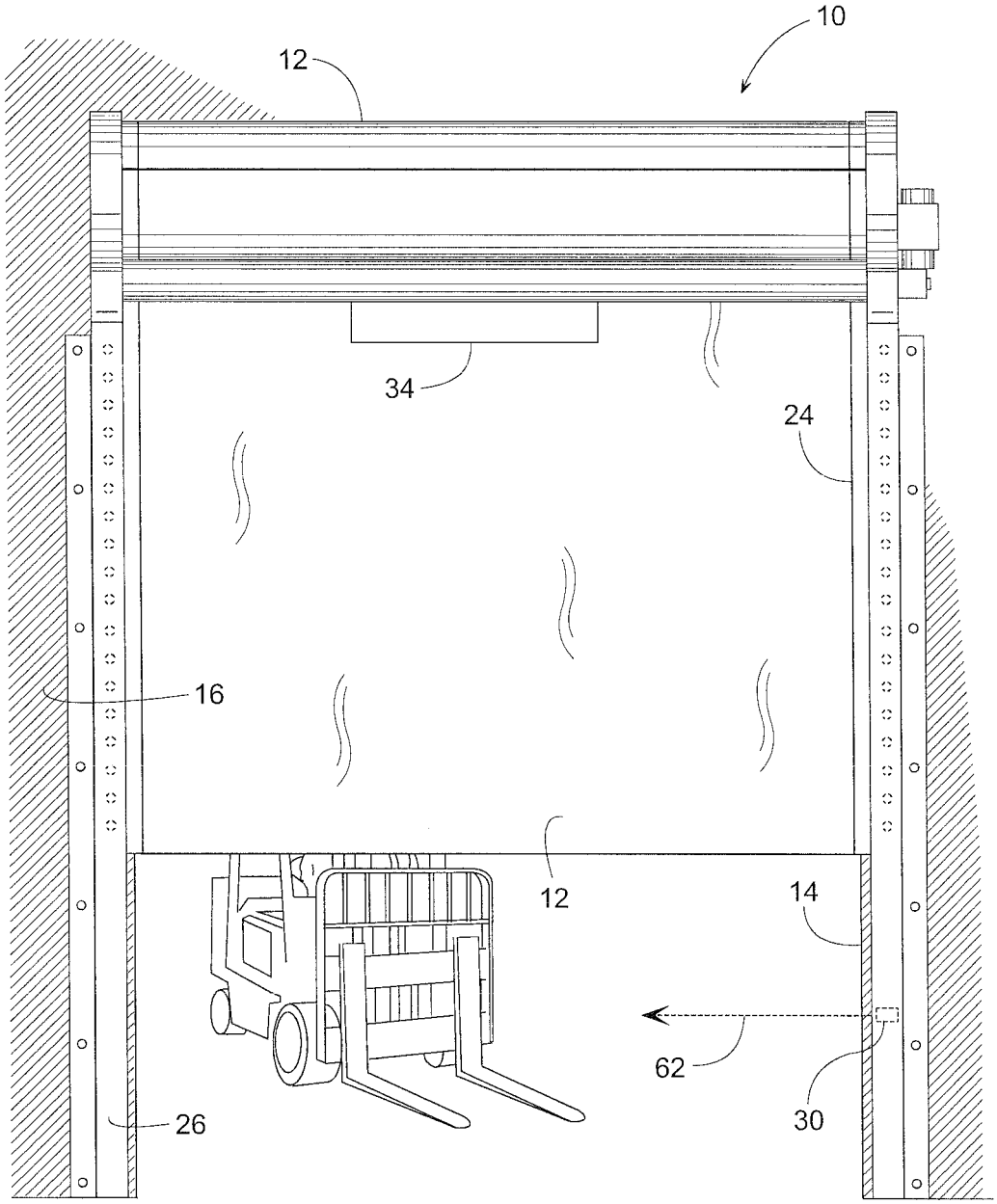
FIG. 2 is a front view of the door of FIG. 1 but with the door shown at an intermediate position between open and closed.
Figure 3:
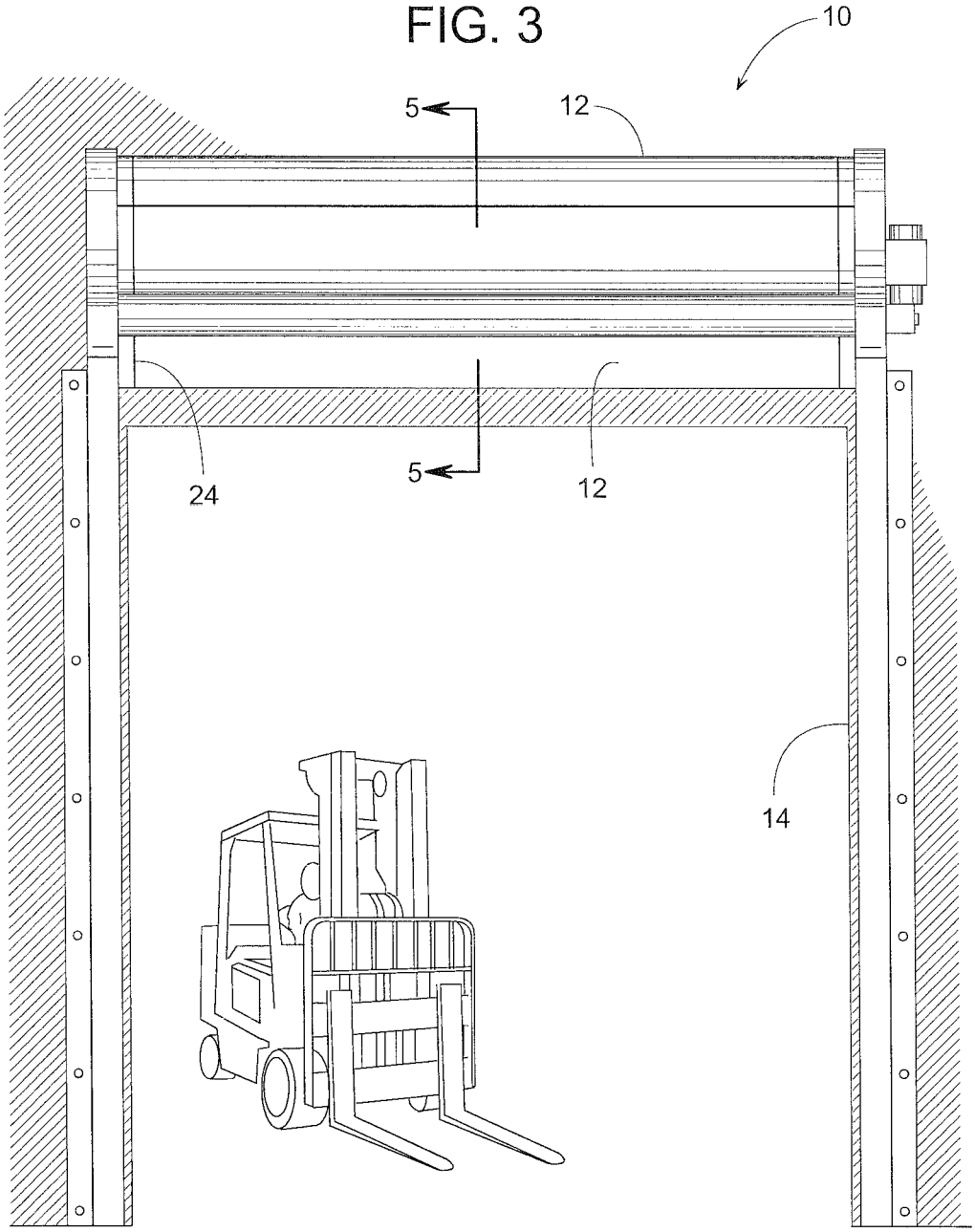
FIG. 3 is a front view of the door of FIG. 1 but with the door shown at its open position.
Figures 4, 18:
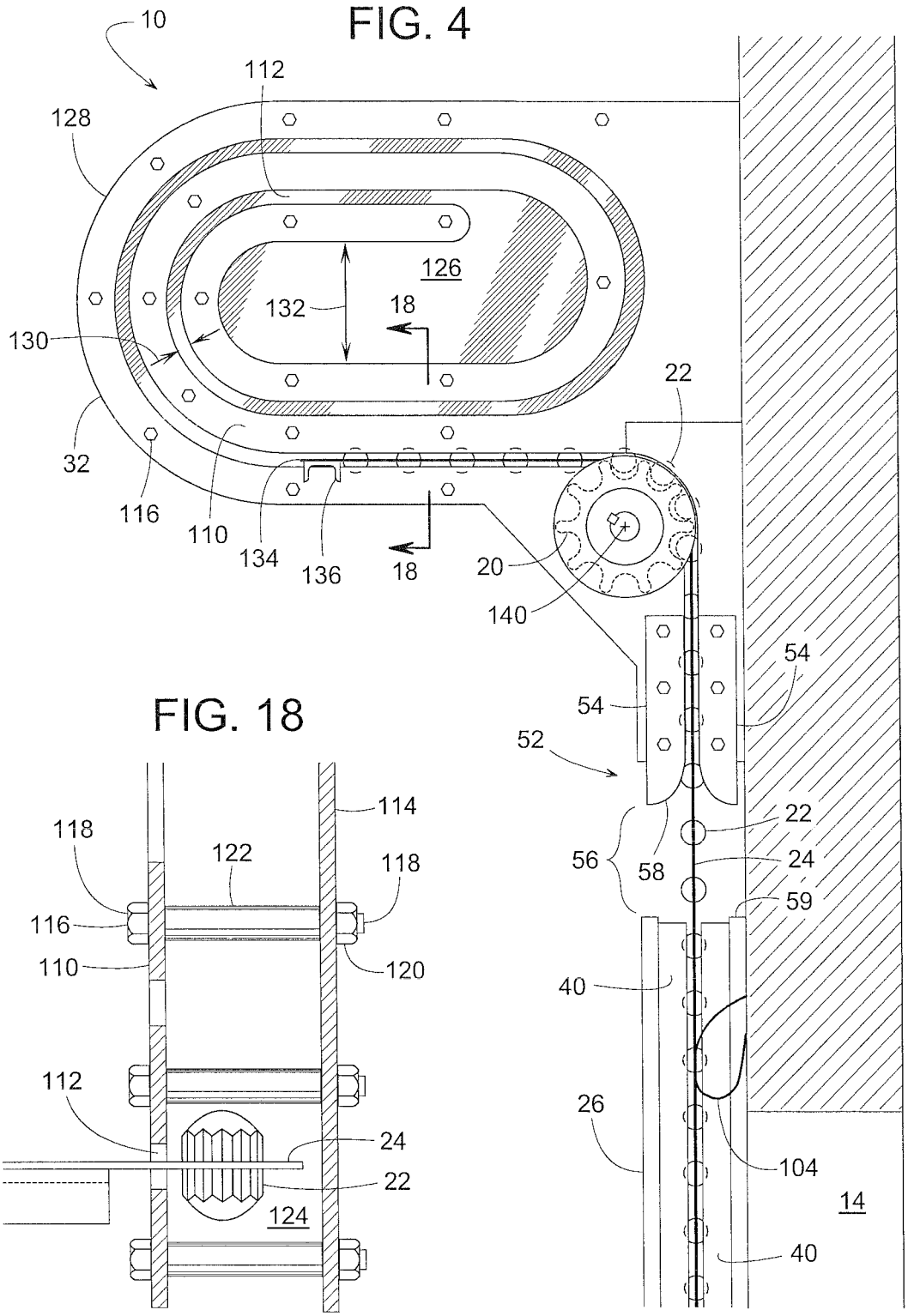
FIG. 4 is a cross-sectional view taken along line 4-4 of FIG. 1.
FIG. 18 is a cross-sectional view taken along line 18-18 of FIG. 4.
Figure 5:
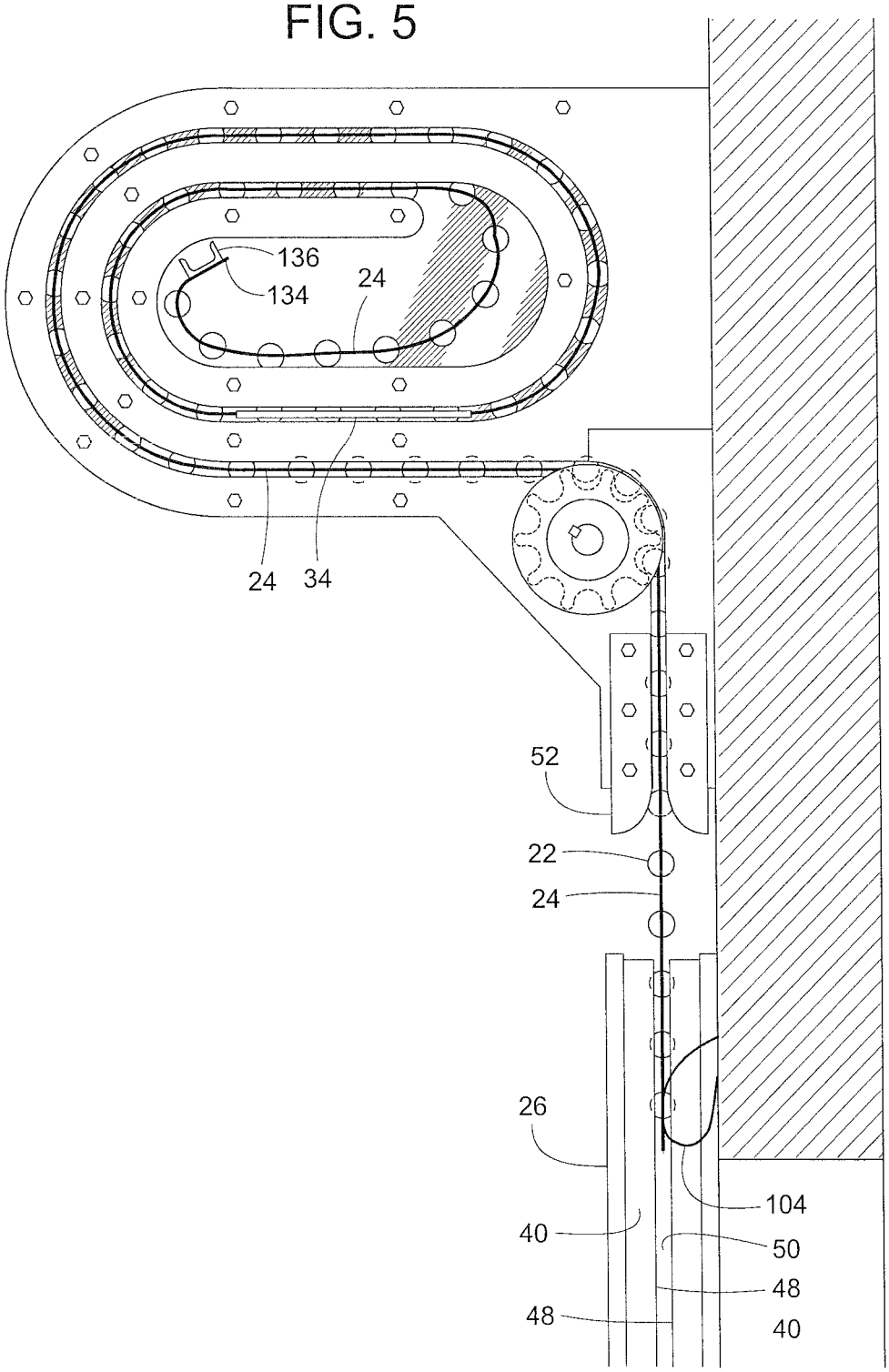
FIG. 5 is a cross-sectional view taken along line 5-5 of FIG. 3.

A door system 10, shown in FIGS. 1-5, includes a panel 12 that moves generally vertically between a closed position (FIGS. 1 and 4) and an open position (FIGS. 3 and 5). FIG. 2 shows panel 12 at an intermediate position relative to a doorway 14 in a wall 16.

The panel shown in FIGS. 1-5 illustratively includes a flexible sheet of a heavy duty industrial fabric as is common in the art. The drive strip and guide/retention system forming part of the inventive aspect of this the description are not limited to combination with a flexible sheet such as a fabric curtain to form the panel. Rather, the system disclosed herein could be used to drive and guide a variety of other panel structures of which it would form a part—such as a so-called rolling steel door with generally rigid, horizontally-extending slats that are hingedly interconnected. The drive system could also be a part of a unitary rigid panel. Use as a part of a flexible fabric panel having additional structure is also possible—such as rigid bars for stiffening, or sections of internal foam or other insulative material to allow use of the door in cold storage type applications.

Whatever overall configuration of panel is used, to raise or lower panel 12, a motor 18 rotates at least one drive gear 20 (FIG. 4) that engages a plurality of spaced apart projections 22 disposed along one or both lateral edges of panel 12. In this embodiment, projections 22 are disposed on and extend from drive strips 24 that form a part of extend continuously along the lateral edges of panel 12. The term "projections" has been used to describe the roughly spherical members (see FIG. 4) mounted on the drive strip 24 since the members project from (in this case both sides of) the generally planar surface of strip 24 so that they can be engaged by and thus driven by drive gear 20 to move the door panel 12. The projection from the surface of drive strip 24 also allows the projections 22 to engage structure in the track of the door to both guide the panel between open and closed positions, and to provide retention of the panel within the track for applied forces, and separation of the panel from the track for applied forces exceeding predetermined thresholds, such as upon application of a crash force to the door. The material that has been identified to best achieve these various design goals for the projections 22 is an impact modified nylon 6/6 with an embedded silicone lubricant, available under model number RTP200HSI2 from RTP Company.

The material forming the drive strip 24 itself, in some embodiments, requires a balance of various characteristics. Since the application of a drive force to the edge of the panel only directly occurs when a projection or projections 22 are in contact with drive gear 20, drive strip 24 needs adequate rigidity to be capable of transmitting that drive force along at least a portion of its length. At the same time, depending on the storage configuration of the door, the panel 12 including drive strips 24 may need to turn corners and/or assume a coiled or other configuration, as in FIGS. 4 and 5. Thus, while the drive strip needs adequate rigidity to transmit driving forces along at least a portion of the edge, it also needs sufficient flexibility to curve around drive gear 20 and/or assume various curved storage configurations. We have found that the balancing of these requirements for an application of some of the inventive aspects of the system as shown in FIGS. 1-5 is best achieved by forming drive strip 24 of a copolymer polypropylene material. It should also be noted that the amount of rigidity required of strip 24 may be reduced by virtue of the fact that strip 24 is guided and retained within track 26. The engagement with track 26 may help keep strip 24 flat (not buckled) and allow it to thus transmit the drive force more effectively.

In one example, drive strip 24 is co-extensive in length with the remainder of the door panel of which it forms a part. In some applications, however, it may be desirable for the strip 24 to extend somewhat less than this full length. Even so, a given drive strip 24 may be continuous or unbroken along its length. In some embodiments, their may be multiple continuous drive strips forming an edge of the panel. As depicted herein, drive strip 24 is formed as a separate member, and is then permanently affixed to the remainder of panel 12 by any of a variety of attachment processes (sewing, gluing, heat-sealing, etc.) When the remainder of panel 12 is formed of a flexible material, the overall panel is thus flexible. In other embodiments (such as the flexible drive strip mounted to a rigid panel) this may not be the case.

Figure 19:
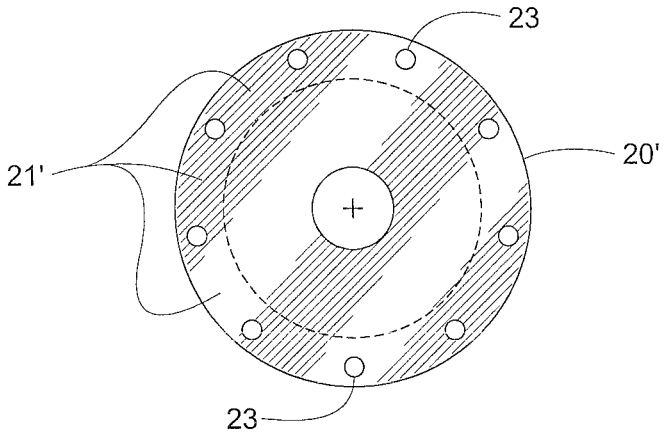
FIGS. 19 and 20 show an alternative embodiment of a drive gear for a door according to the description.
Figure 20:
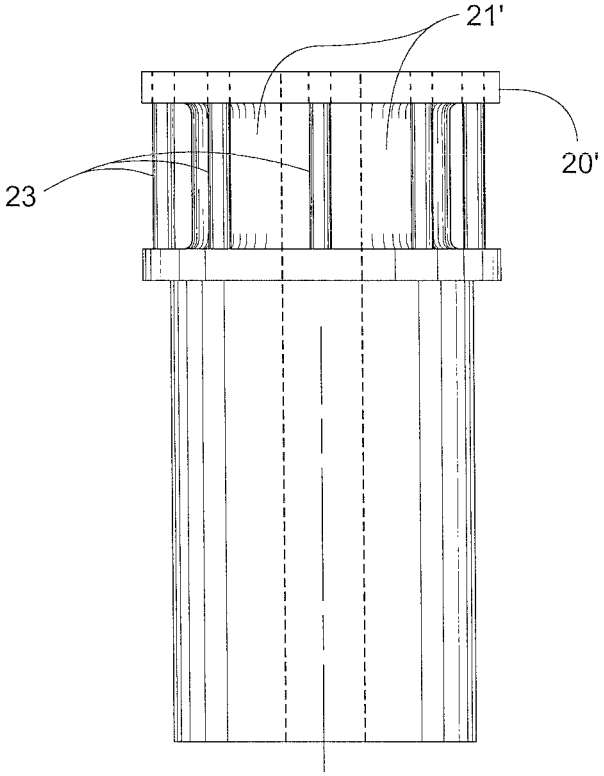

The drive gear 20 is seen in cross-section in several of the figures. In general, it has a cylindrical shape with depressions for receiving projections 22 to thus drive the panel 12. Toward this end, some form of motor (appropriately geared) is provided to drive the gear 20 in rotation. In this case, the depressions in the gear 20 are in the form of laterally-extending grooves 21, seen in cross-section in FIG. 5*a*, for example. The grooves 21 are complementary in shape to the half of the projections 22 that engage the drive gear 20. The entire drive gear 20 may be molded from a material such as urethane. To date, the best material identified for forming drive gear 20 is a PTMEG urethane with a TDI prepolymer—formed from a combination of TD-D75E and EXT-1027-1 compounds available from ITWC. As an alternative to a molded or cast part, blank pieces may be machined and/or assembled to form drive gear 20. An example of this is shown in FIGS. 19 and 20, which depict a drive gear in the form of a spool 20'. To form grooves 21' corresponding to grooves 21 in FIG. 5*a*, pins 23 extend across the larger flange of the spool such that the volume between the pins 23 corresponds to the engaged grooves 21'.

Door system 10 includes many unique features that make it superior to other doors. System 10, for instance, can be made impact resistant by allowing its panel 12 to safely breakaway from its guide track 26 in the event of an impact. In such breakaway embodiments, door system 10 can be selectively configured to achieve different levels of breakaway force. In a current example, panel 12 remains completely intact even after breaking away from an entirely stationary guide track, such as track 26.

Other unique features of door system 10 include: track 26 including a chamber 28 (FIG. 6) that protectively houses a sensor 30; a panel storage track 32 that supports panel 12 in a loose wrap that helps prevent a plastic panel window 34 from contacting itself or the remaining curtain material when coiling or coiled to prevent scratching and which permits ventilation that can reduce condensation within the wrapped panel; a selectively configurable storage track 36 (FIGS. 16 and 17); a flexible seal 38 (FIG. 6) disposed within track 26; and a unique drive mechanism that includes drive gear 20 engaging projections 22 on drive strip 24 (which may be a continuous strip). Additional details of the aforementioned features plus other features will now be explained with the following more detailed description.

Figure 6:
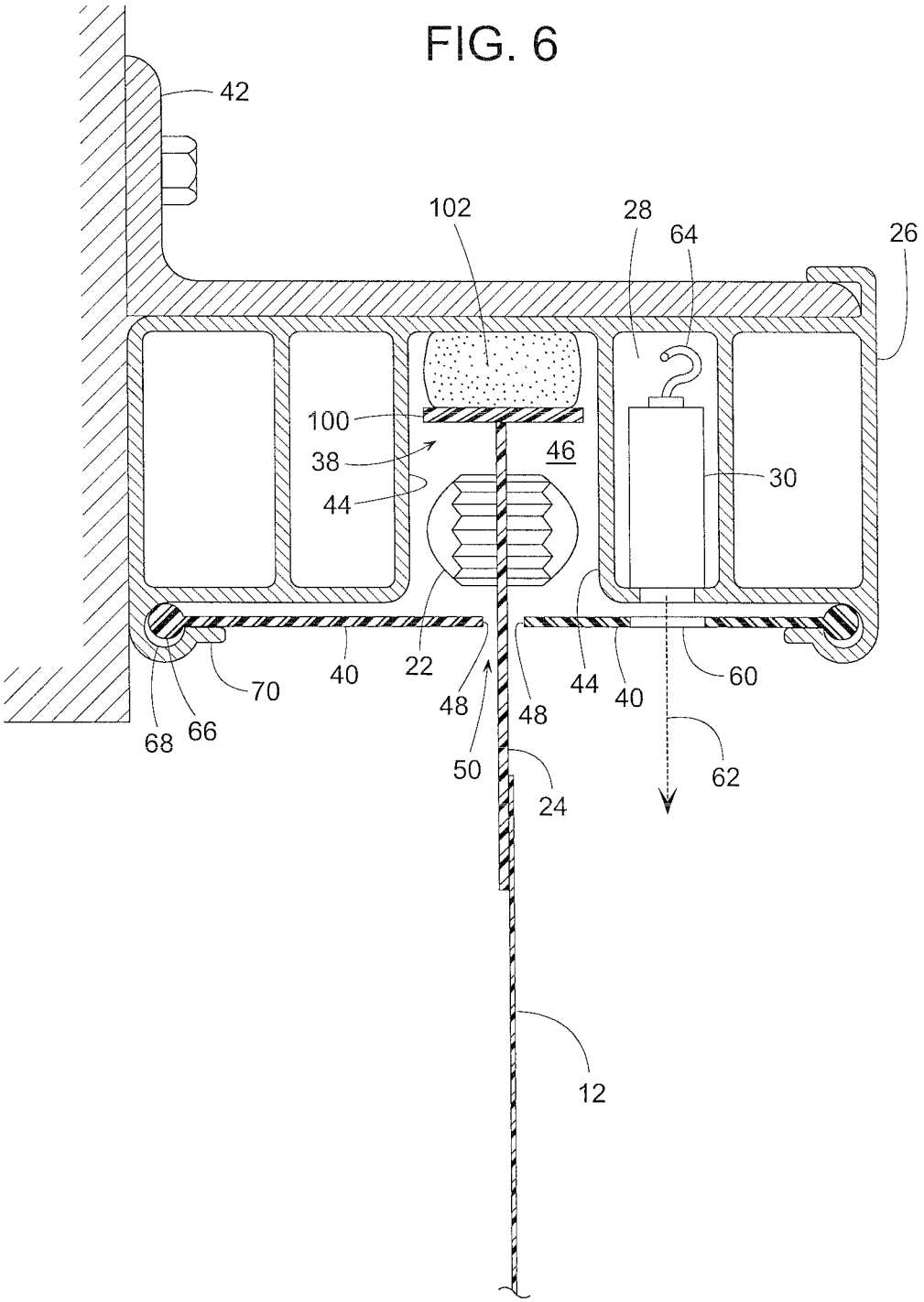
FIG. 6 is a cross-sectional view taken along line 6-6 of FIG. 1.

To help guide the movement of panel 12, two drive strips 24 forming the lateral edges of panel 12 extend into track 26 on either side of doorway 14. Referring to FIG. 6, track 26 has a generally uniform cross-sectional shape that allows it to be formed, for example, by an extrusion process, although other fabrication methods could be used. The track 26 has features that provide various functions, such as guiding drive strips 24 along track 26, supporting one or more flexible retention strips 40 that help hold and guide drive strip 24 within track 26, and housing sensor 30. In some cases, an additional wall-mounting bracket 42 can be welded or otherwise attached to the extruded portion of track 26. In the current embodiment, track 26 and bracket 42 are both extruded aluminum.

Figure 7:
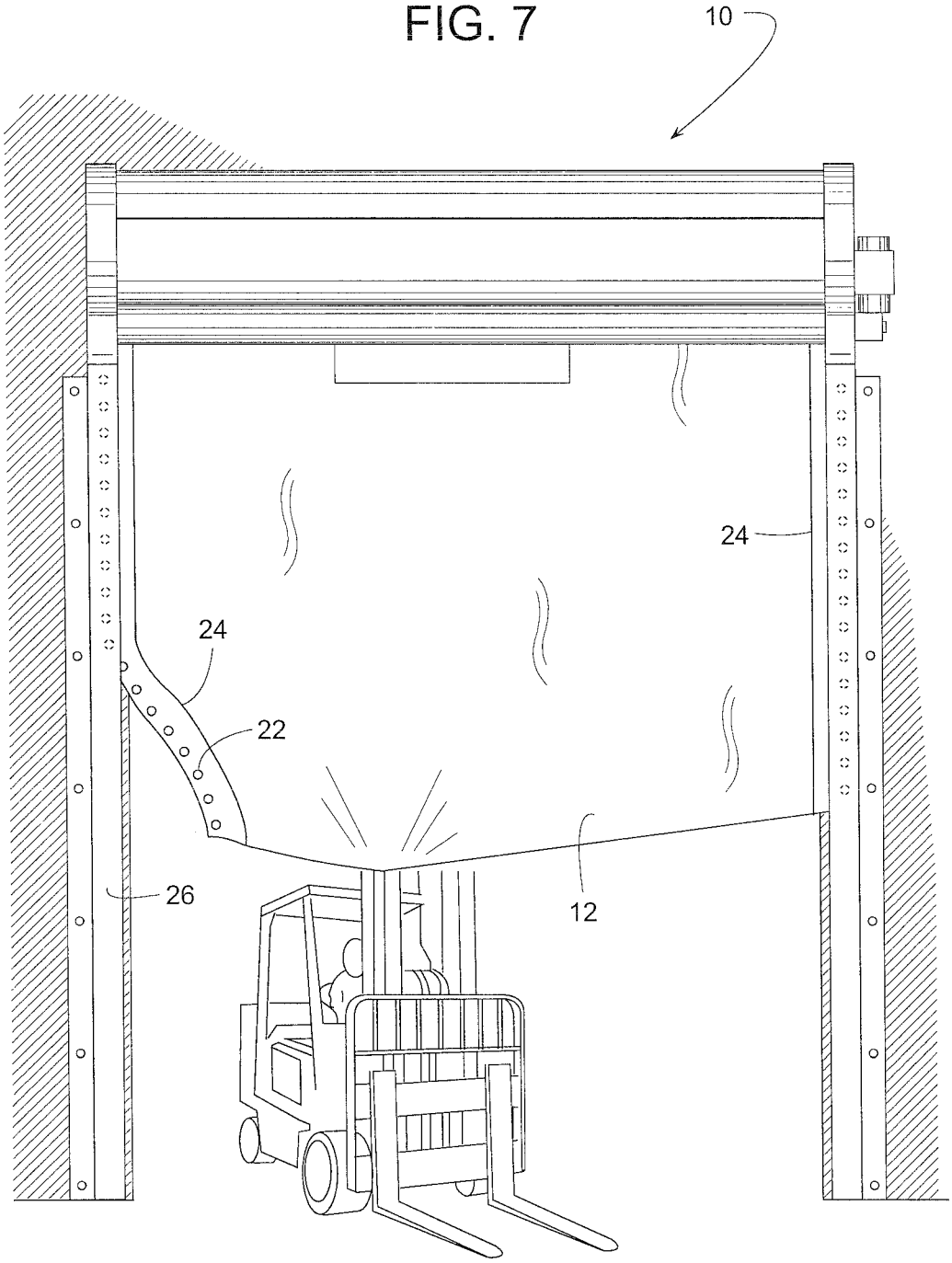
FIG. 7 is a front view similar to FIG. 2 but showing a forklift crashing into the door's panel.
Figure 8:
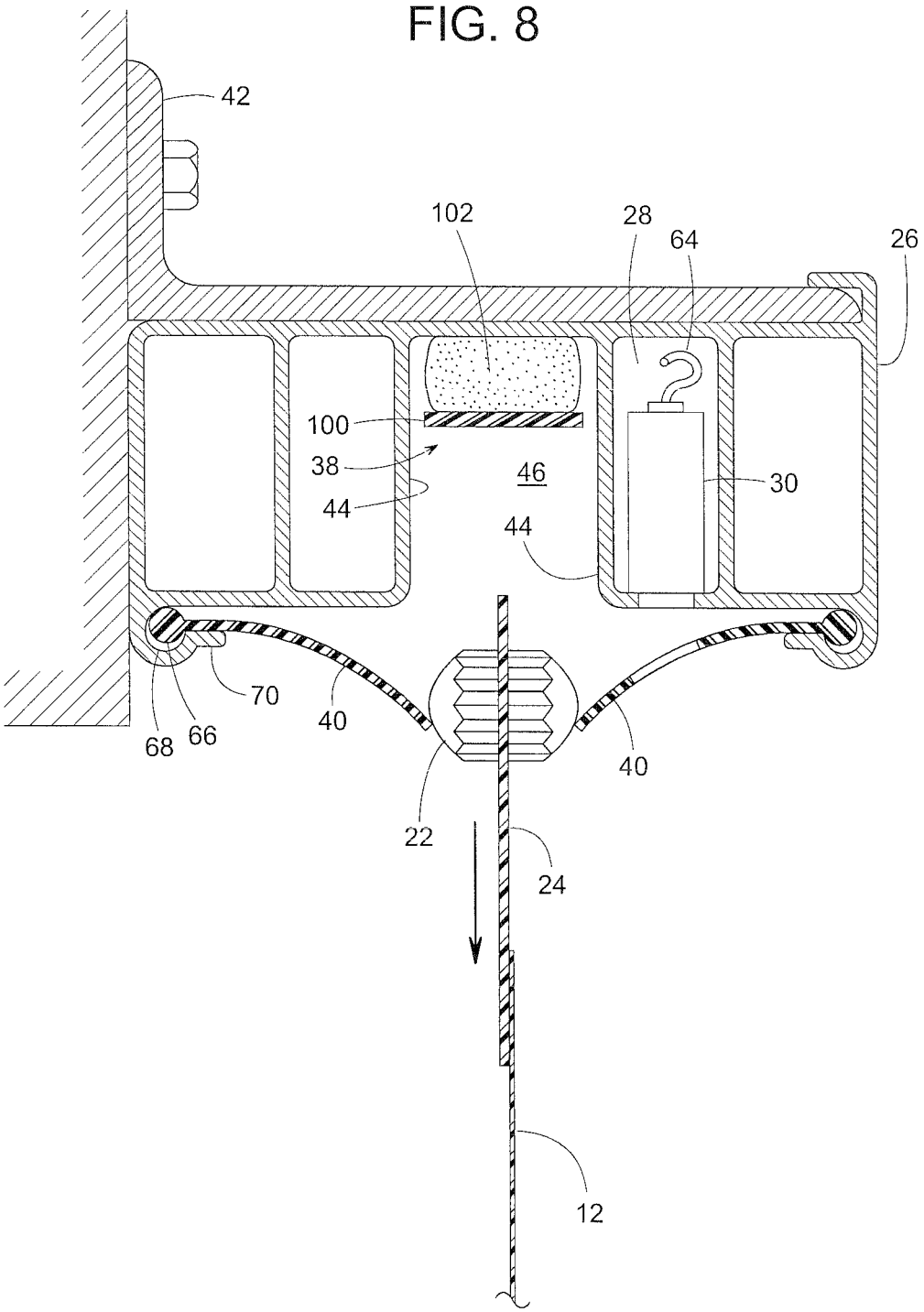
FIG. 8 is a cross-sectional view similar to FIG. 6 but showing a portion of the drive strip about to breakaway from the track.

Still referring to FIG. 6, track 26 includes a channel 44 along which drive strip 24 travels. To help contain drive strip 24 within a panel passageway 46 of channel 44, flexible retention strip 40 captures the plurality of projections 22 within channel 44. In this manner, projections 22 serve the dual function of engaging drive gear 20 to drive panel 12 while also providing a guiding and retaining function for the panel by virtue of their engagement with track 26 and retention strips 40. In one example, two retention strips 40 are attached to each track 26 such that two distal edges 48 are spaced apart to define a slot 50 through which drive strip 24 extends. By selecting the material or thickness of the strip 24, strip 24 can be made to have a certain amount of flexibility so that if panel 12 is impacted, as shown in FIGS. 7 and 8, the flexibility of the strip 24 allows the impact to force strip 24 and projections 22 out from within channel 46 to a dislodged position without damage or any significant permanent distortion of the door parts. If the impact dislodges panel 12 near the bottom of panel 12, as shown in FIG. 7, projections 22 may allow the lower portion of the panel 12 to progressively break away from the bottom-up in a zipper-like fashion (i.e. one projection after another), thus reducing the force necessary to initiate or continue a breakaway. When the drive strip 24 and projections 22 are within the channel 46, the engagement of multiple projections 22 simultaneously with the retention strip 40 allows the door to have a high overall resistance to a more broadly distributed force such as that created by wind.

After a portion of panel 12 is dislodged, projections 22 of drive strip 24 are readily fed back into channel 46 by simply driving the door to its open position. As a partially dislodged panel 12 rises to the open position, an auto-refeed device 52 (FIG. 4) forces projections 22 back inline with track 26. In some embodiments, auto-refeed device 52 comprises two guide plates 54 and a vertical space 56 between plates 54 and an upper edge 59 of track 26. Space 56 provides an open path for projections 22 to pass from their dislodged position to their normally inline position within track 26, and guide plates 54 have a lead-in edge 58 that helps direct projections 22 back into their normally aligned position. One of skill in the art will appreciate that a variety of shapes or edges could be applied to plates 54 to facilitate re-entry of projections 22 into track 26. Guide plates 54 may be more rigid than retention strips 40.

Figure 21:
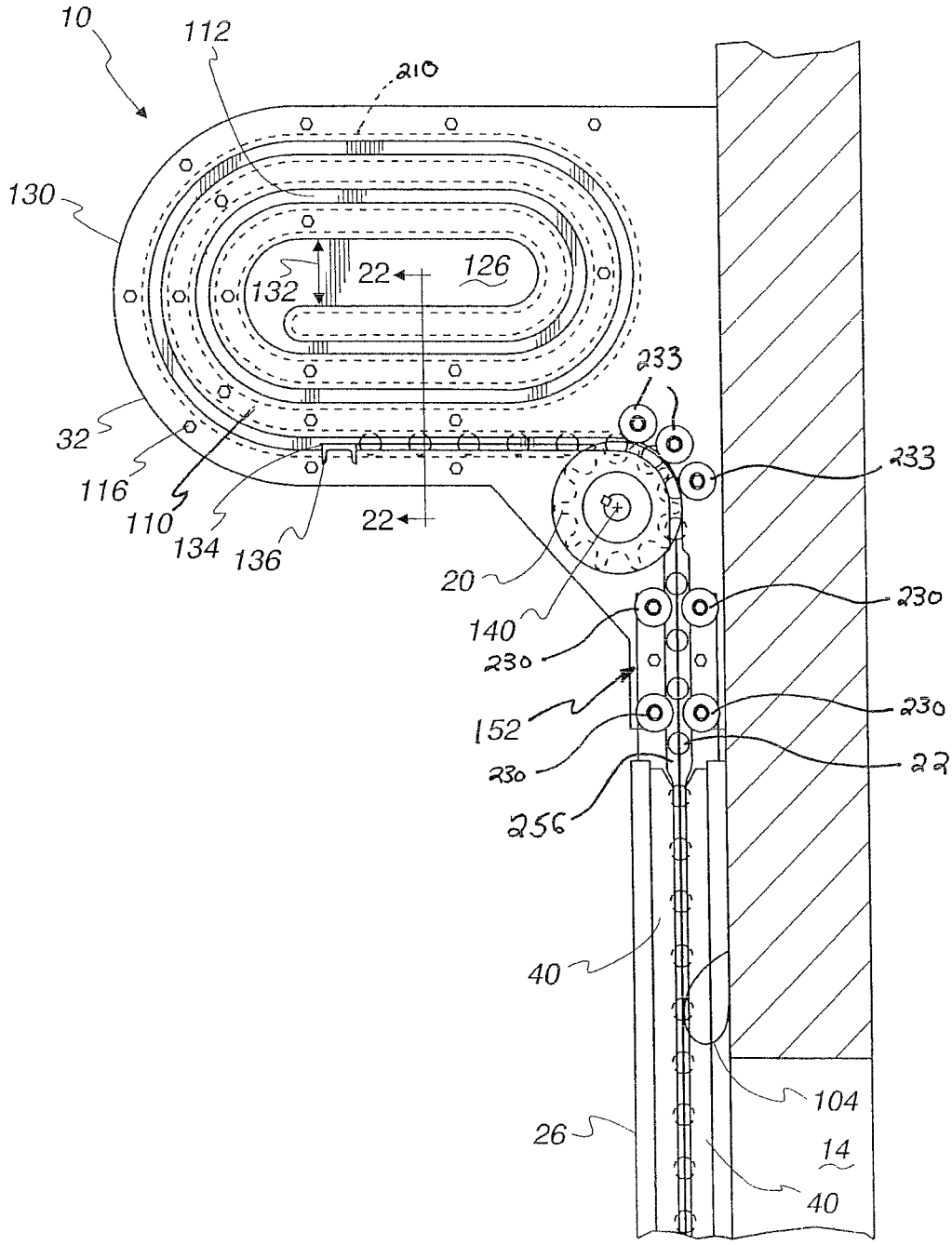
FIG. 21 is a cross-sectional view of an alternative embodiment of the door similar to FIG. 4
Figure 24:
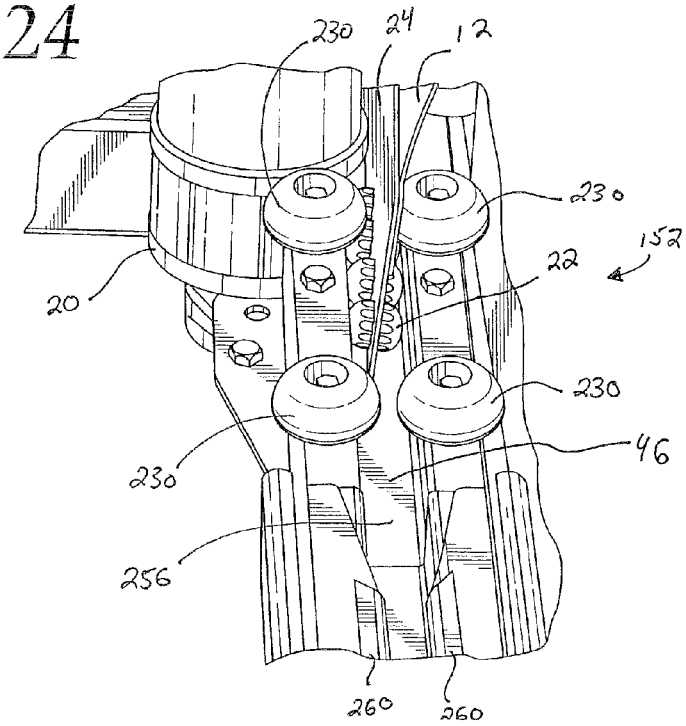
FIG. 24 is a perspective view of an example auto-refeed device.

For example, FIGS. 21 and 24 illustrate an alternative auto-refeed device 152 wherein the projections 22 of drive strip 24 are readily fed into the channel 46 by at least one roller 230. In this example, the auto-refeed device 152 includes two pairs of corresponding free wheeling rollers 230 spaced apart along the length of the track 26, and located inward of the track 26 towards the door panel 12. The track 26 defines a space 256 that provides an open path for projections 22 to pass from their dislodged position to their normally inline position within the track 26. For instance, in operation, the drive gear 20 withdraws the panel 12 and the dislodged projections 22 toward the auto-refeed device 52 where the rollers 230 contact the projections 22 and rotate to guide the projections back into the track 26. Accordingly, it will be appreciated that any number and/or configurations of rollers may be utilized to re-feed the projections 22 into the channel 46. Additionally, each of the rollers 230 may be of any suitable shape to re-feed the projections 22 into the channel 46, including, for example, generally toroidal as illustrated, hemispherical, elliptical, frusco-conical, flat-disk, etc. Furthermore, the number, shape, size, and material of the rollers 230 may vary as desired.

Referring back to FIG. 6, when sensor 30 is to be installed within chamber 28 of track 26, retention strips 40 may need to be transparent or the retention strip may include a hole 60 through which a beam 62 of sensor 30 may pass. The term, "sensor" represents any element that emits, receives, or reflects a signal. Typically, a photoelectric eye is used for this purpose, although other sensors could be employed. Photoelectric eye 30 can be used for detecting when an obstruction may be in the path of the door's panel 12. Upon sensing such an obstruction, photoelectric eye 30 might trigger an appropriate response, such as stopping or reversing the descent of panel 12. Supply and/or signal wiring 64 can be conveniently fed through chamber 28. Moreover, housing sensor or photoeye 30 within the chamber 28 keeps it protected from dust and other performance-limiting contaminants as well as protecting it from impact. It should be appreciated that, while a specific shape of track has been shown with a specific chamber 28, that a wide variety of track shapes including such a chamber of chambers could be provided without departing from the inventive concepts herein.

Figure 6A:
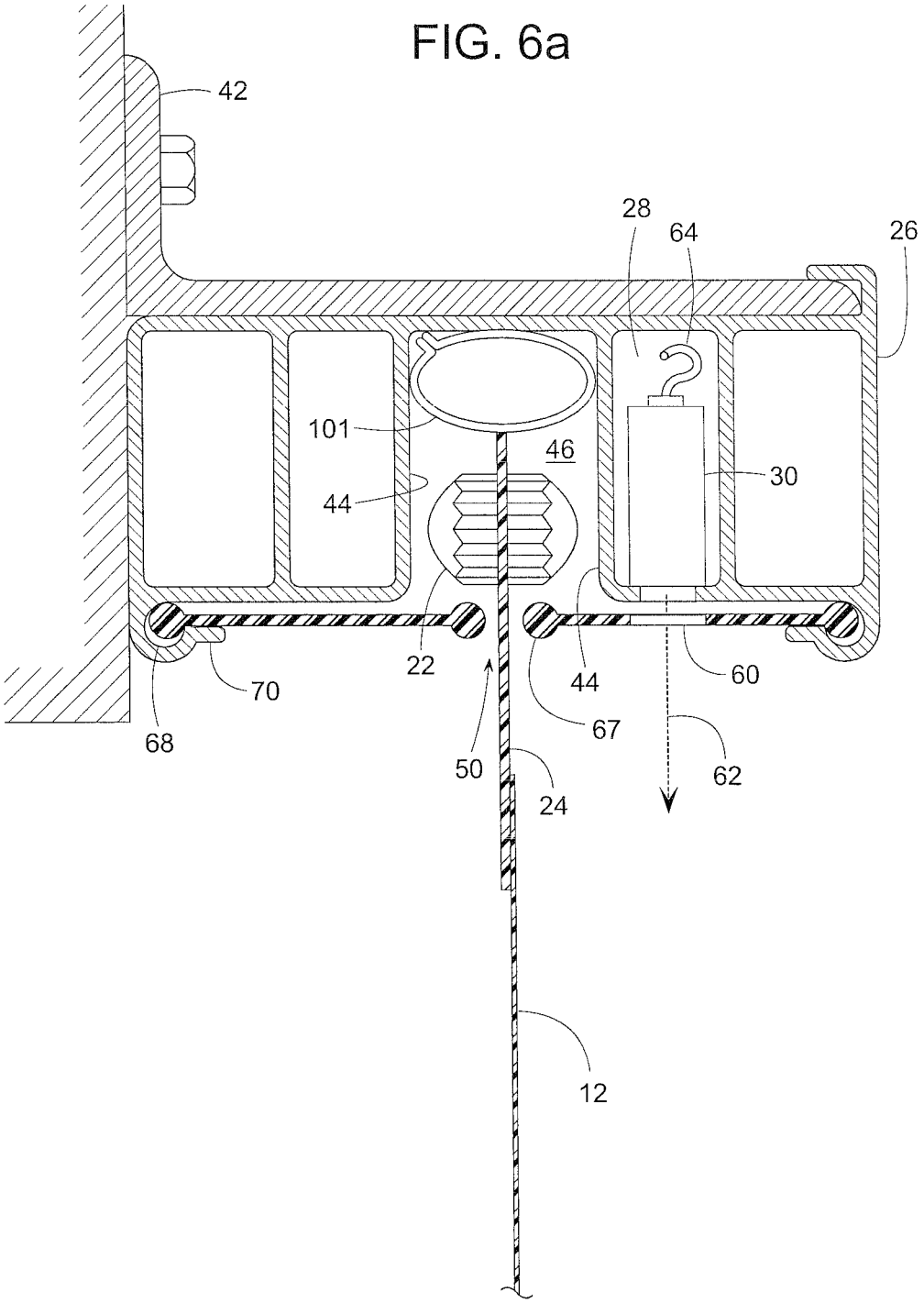
FIG. 6*a* is similar to FIG. 6, but showing additional inventive features.

Although various means could be used for attaching retention strip 40 to track 26, in one example, a proximal edge 66 of each strip 40 is held within a retaining structure illustratively in the form of groove 68 defined by track 26. Retention strip 40 can be made of various materials including, but not limited to, an extruded piece of LEXAN, which is a registered trademark of General Electric of Pittsfield, Mass. Strip 40 can be extruded to form proximal edge 66 as an enlarged bead that helps hold strip 40 within groove 68. A small flange 70 on track 26 helps hold retention strip 40 across the opening of channel 44. Other arrangements, such as using mechanical or other fasteners to attach retention strip 40 to track 26 could also be used. In addition, an alternative embodiment of the retention strip 40 is shown in FIG. 6*a*. In this embodiment, strip 40 includes an enlarged bead 67 at the distal edge thereof. The presence of such beads at the distal edge of the strips 40 may reduce wear from the panel passing thereby and may also facilitate a wedging action between projections 22 and the strip 40 for a breakaway condition (see FIG. 8).

Figure 25:
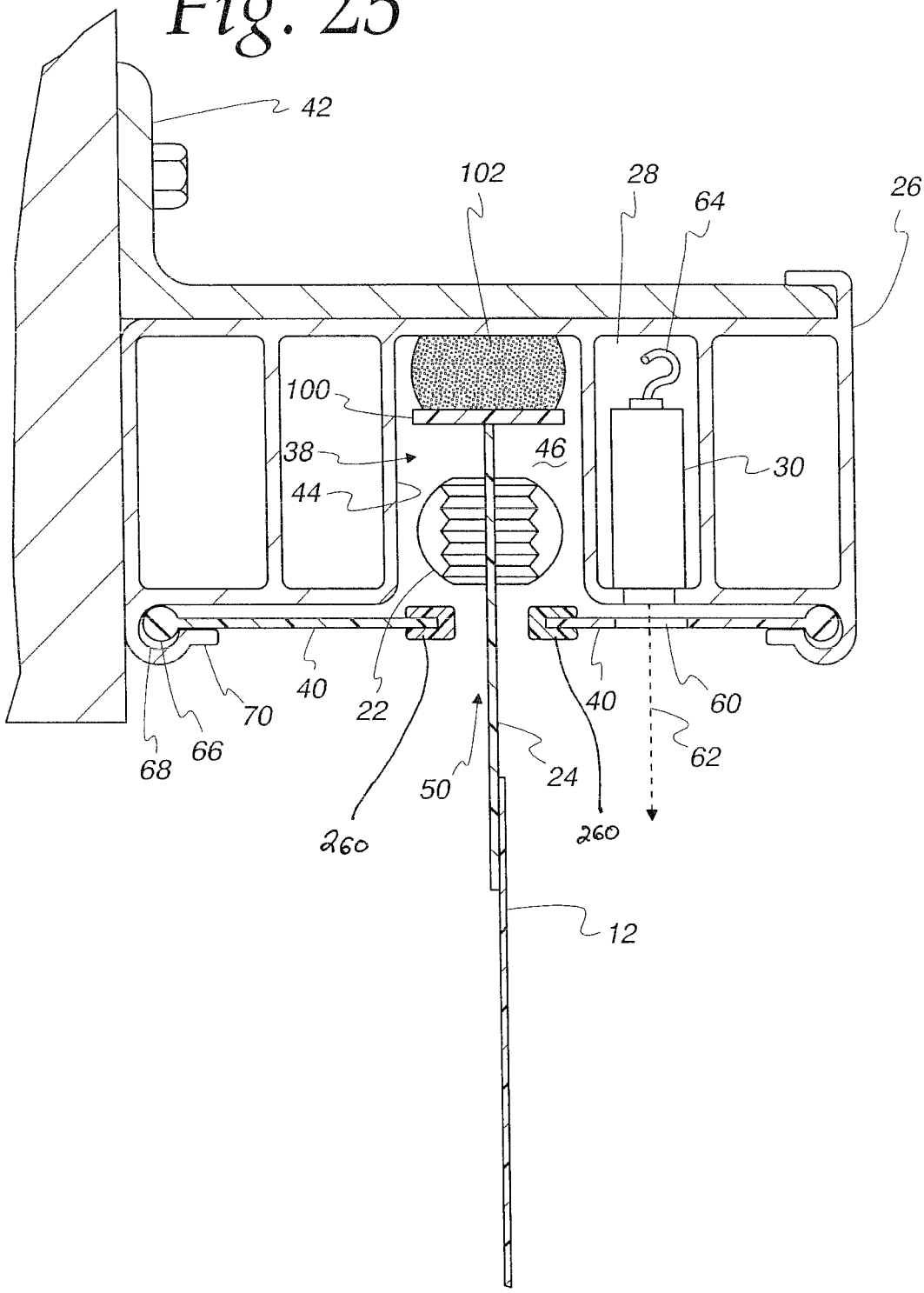
FIG. 25 is a cross-sectional view of an alternative embodiment of the door track, similar to FIG. 6.

Another alternative embodiment of the retention strip 40 is shown in FIG. 25. In this embodiment, the strip 40 includes a reinforcing edge 260 coupled at the distal edge thereof. The reinforcing edge 260 may be separately or integrally formed with the retention strip 40. In this example, the reinforcement edge 260 is generally u-shaped and is resiliently biased so as to frictionally engage the distal end of the retention strip 40. However, it will be appreciated by one of ordinary skill in the art that the shape of the reinforcement edge 260, as well as the coupling manner between the edge 260 and the strip 40 may vary as desired. Furthermore, the reinforcement edge 260 may be constructed of an abrasion-resistant material, such as, for example nylon, and/or may be sufficiently stiff in construction to serve to stiffen the strip 40. Accordingly, the presence of the edge 260 may reduce wear from and/or to the panel 12 passing thereby and may also allow for an increase size in the gap 50 without sacrificing resistance to panel break away, further reducing wear.

Figure 9:
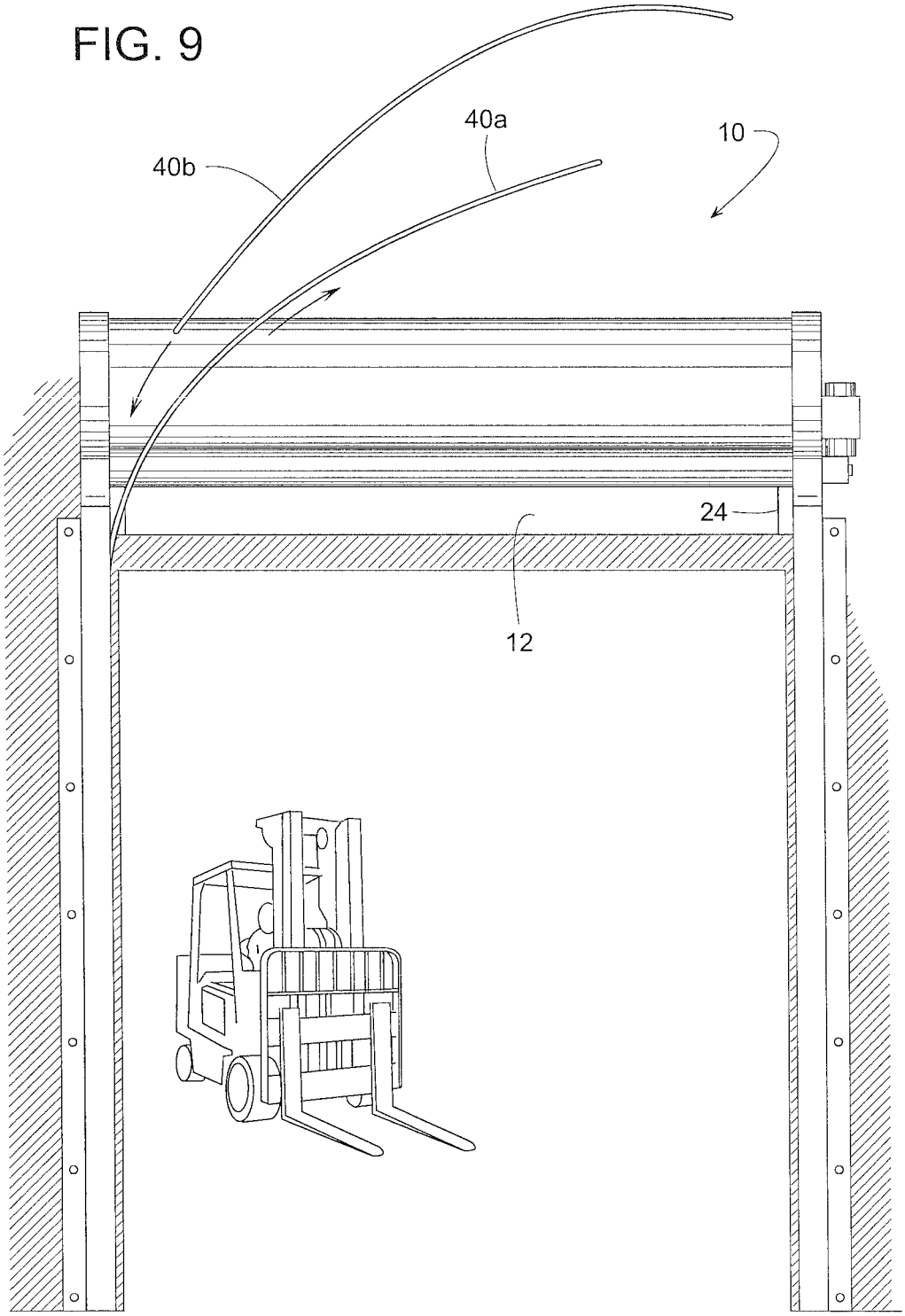
FIG. 9 is a front view similar to FIG. 3 but showing a retention strip being changed.

Referring to FIG. 9, the threshold of the force needed for panel 12 to break away can be changed by replacing a first retention strip 40*a* with a second retention strip 40*b*, wherein strips 40*a* and 40*b* have different degrees of flexibility by virtue of the strip's shape, thickness and/or material properties. Strip 40*a* can be readily removed and strip 40*b* can be readily installed by sliding strips 40*a* and 40*b* vertically along groove 68. During the removal and installation process, the flexibility of strips 40*a* and 40*b* can aide in maneuvering the strips around obstacles.

Referring again to FIG. 25, the illustrated example may be utilized as another way to change the threshold force needed for panel 12 to break away from the track 26. In particular, in this example, the reinforcement edge 260 of each of the strips 40 may alternatively and/or additionally be replaced with edges having different degrees of flexibility and stiffness. Therefore, by merely changing the reinforcement edge 260, the overall characteristics of the retention strip 40 may be modified without necessarily removing the strip 40 from the groove 68.

Figure 10:
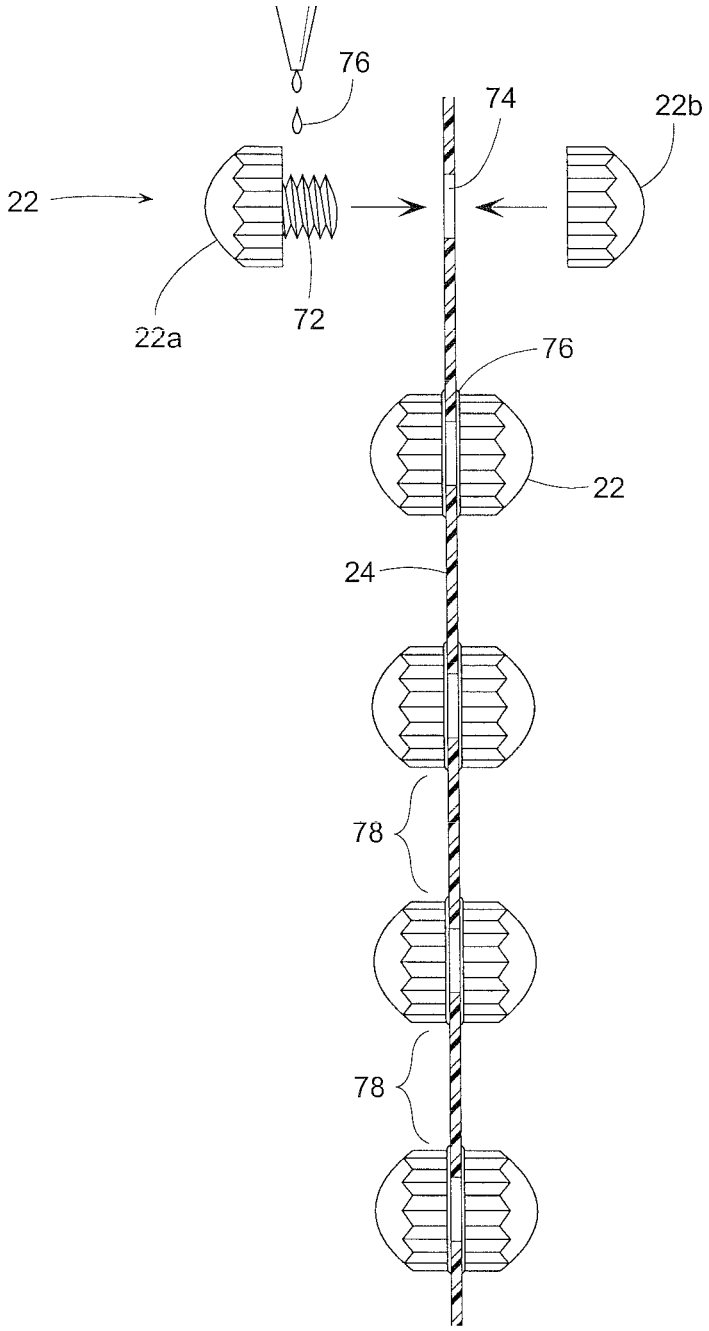
FIG. 10 is a cross-sectional side view of a drive strip with a projection assembly being installed.

FIG. 10 shows one way drive strip 24 can be provided with projections 22. In this example, each projection comprises a two-piece assembly similar to a threaded nut and bolt. One piece 22*a* has an externally threaded shank 72 that screws into an internally threaded mating piece 22*b* to create a threaded joint that helps fasten projections 22 to drive strip 24. Piece 22*a* is inserted into one of a series of holes 74 in strip 24, and mating piece 22*b* is then screwed onto shank 72 to hold the projection assembly in place. An adhesive 76 can be added to create a more solid connection between pieces 22*a* and 22*b* as well as a more solid connection between projection 22 and strip 24. While the adhesive is shown as applied to the threads of projections 22, it could be applied to other surfaces thereof, or to strip 24. Alternatively, a tape or other high friction material could be placed between the halves of the projections 22 to enhance the grip. A tape could even be applied along the length of strip 24. Relatively thin sections 78 between adjacent projections provide drive strip 24 with sufficient flexibility. Because the wear between drive gear 20 and drive strip 24 is distributed over many projections but just a few gear depressions of grooves 21, drive gear 20 may be made of metal or some other material that is harder or more wear resistant than projections 22. At the same time, the multiple contact events between the projections 22 and drive gear 20 may produce undesirable operating noise if drive gear 20 is formed of a harder material such as a metal. Accordingly, it may be desirable to form drive gear 20 of a generally softer material to reduce noise, although this could give the gear less than ideal wear characteristics. In short, the inventive concept is not limited by the relative hardness of the projections 22 and drive gear 20.

Figure 11:
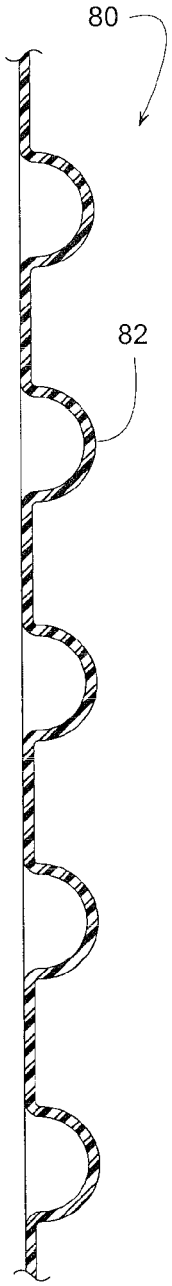
FIG. 11 is a cross-sectional side view similar to FIG. 10 but showing an alternate drive strip with integral projections.
Figure 12:
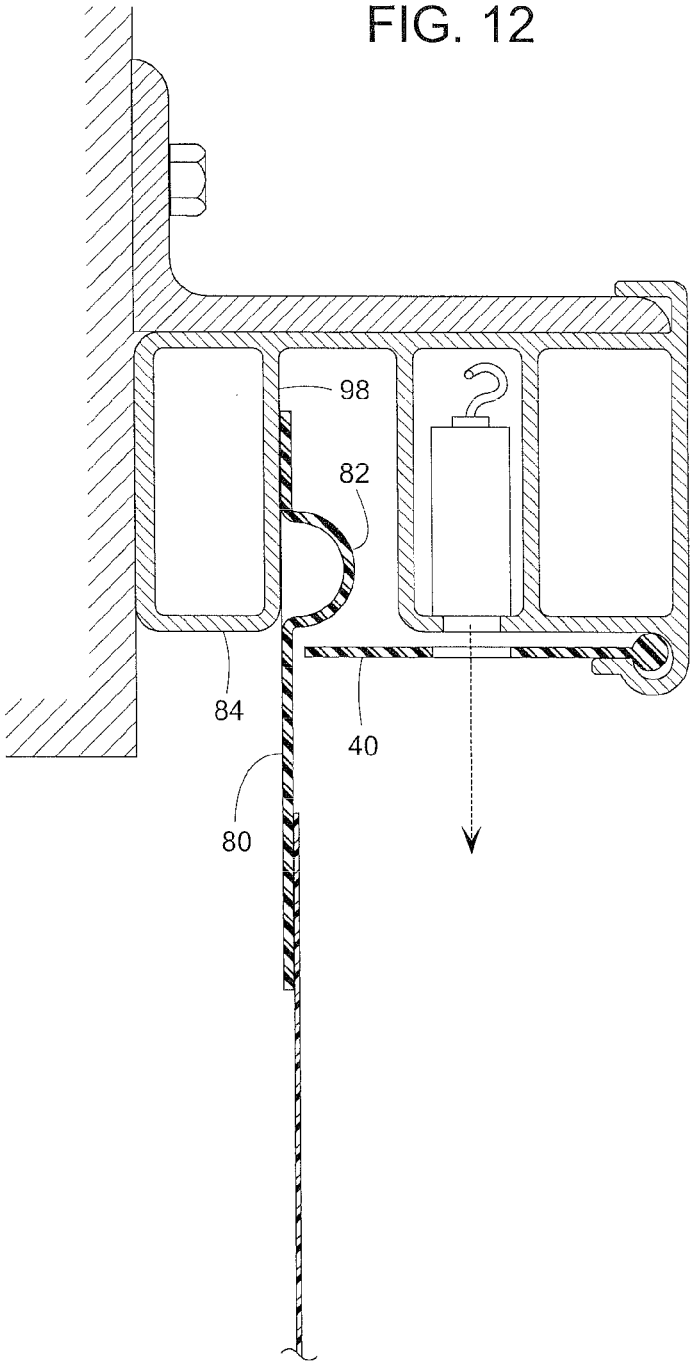
FIG. 12 is a cross-sectional view similar to FIG. 6 but with the drive strip of FIG. 11.
Figure 13:
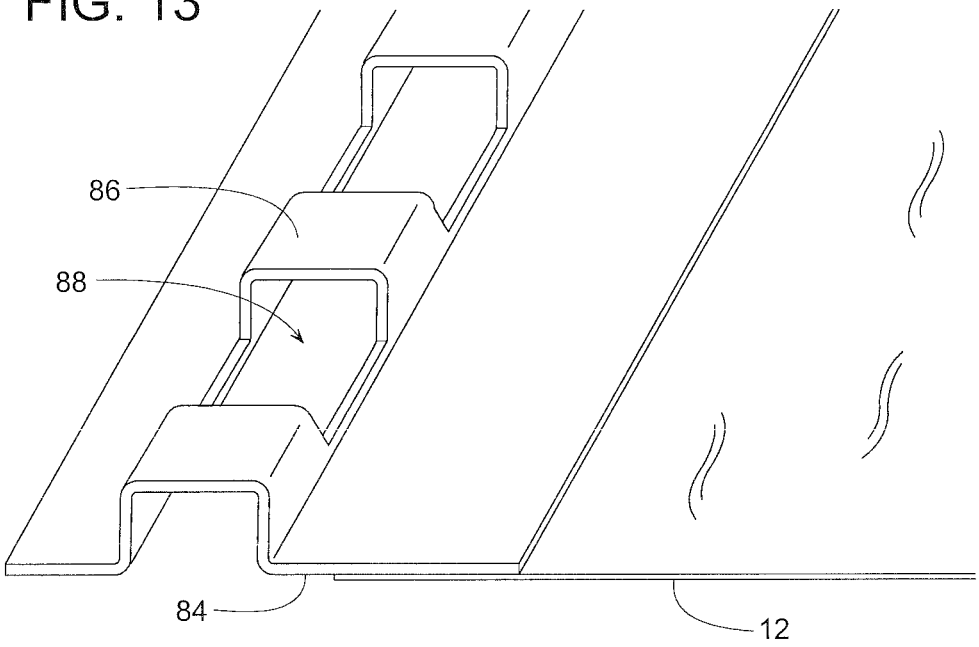
FIG. 13 is a perspective view of another drive strip with integral projections.
Figure 14:
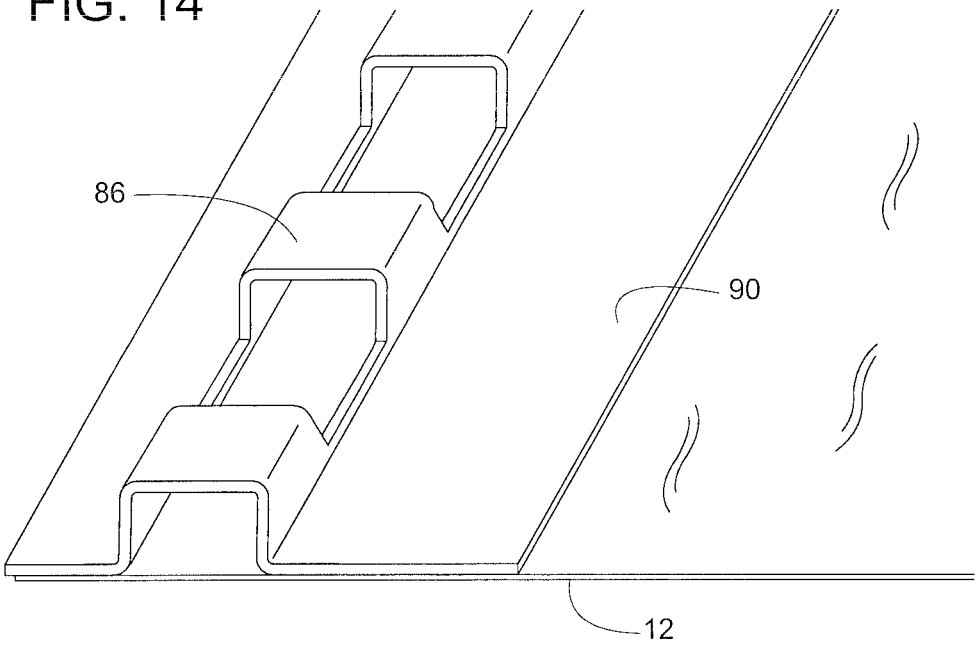
FIG. 14 is a perspective view similar to FIG. 13 but slightly modified.
Figure 15:
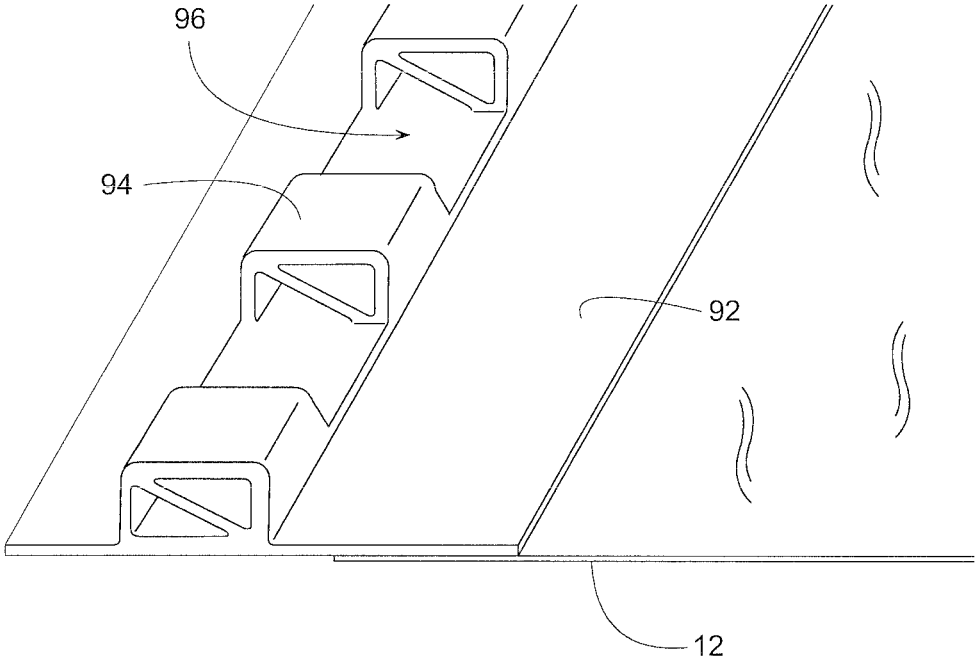
FIG. 15 is a perspective view similar to FIG. 13 but showing a different embodiment.

In an alternate embodiment, shown in FIGS. 11 and 12, a drive strip 80 includes a plurality of projections 82 that are integrally formed into strip 80 by some suitable process such as vacuum forming or pressing. As is apparent from the drawing, these projections only project from one plane of the drive strip 24. As is also shown, the "plane" of drive strip 24 need not extend under the projection 22 therefrom. Another modification well within the scope of the disclosure would be to provide a track 84 that includes only one retention strip 40, as shown in FIG. 12. FIG. 13 illustrates yet another embodiment of a drive strip 84, wherein projections 86 are created by cutting notches 88 in an extruded strip. Notches 88 provide drive strip 84 with the ability to flex around a drive gear and various shaped tracks. FIG. 14 shows a similar drive strip 90, but in this example, a flexible material 12 forming the remainder of the panel extends across the full width of strip 90 to reinforce projections 86. FIG. 15 shows another embodiment where projections 94 are created by machining notches 96 into an extruded piece.

With projections 82, 86 or 94 on just one side of the drive strip, broad sealing contact could exist between a non-projection side of the drive strip and a facing surface 98 of track 84, thereby perhaps eliminating the need for seal 38 of FIG. 6. If, however, seal 38 is installed within track 26, seal 38 may comprise a flexible sealing strip 100 made of wear resistant material. Sealing strip 100 can be backed by a foam pad 102 or some other member that urges strip 100 in sealing contact against the edge of drive strip 24, thereby inhibiting air from leaking past panel 12 via track 26. FIG. 6*a* shows an alternative embodiment of a side seal. In this case, a loop 101 of fabric or other flexible material is disposed within track 26. The fabric loop 101 may have adequate structure to maintain its cross-sectional shape to provide a sealing function, but foam or captured air (or other compressible fluid) may be disposed inside to enhance this functionality. To prevent air from passing over the top of panel 12, a head seal 104 can be installed as shown in FIG. 4. Alternatively, a similar form of head seal could be carried on the panel 12 so that it would contact the wall or lintel at a similar vertical location to that shown in FIG. 4 with the door in the closed position.

Figure 16:
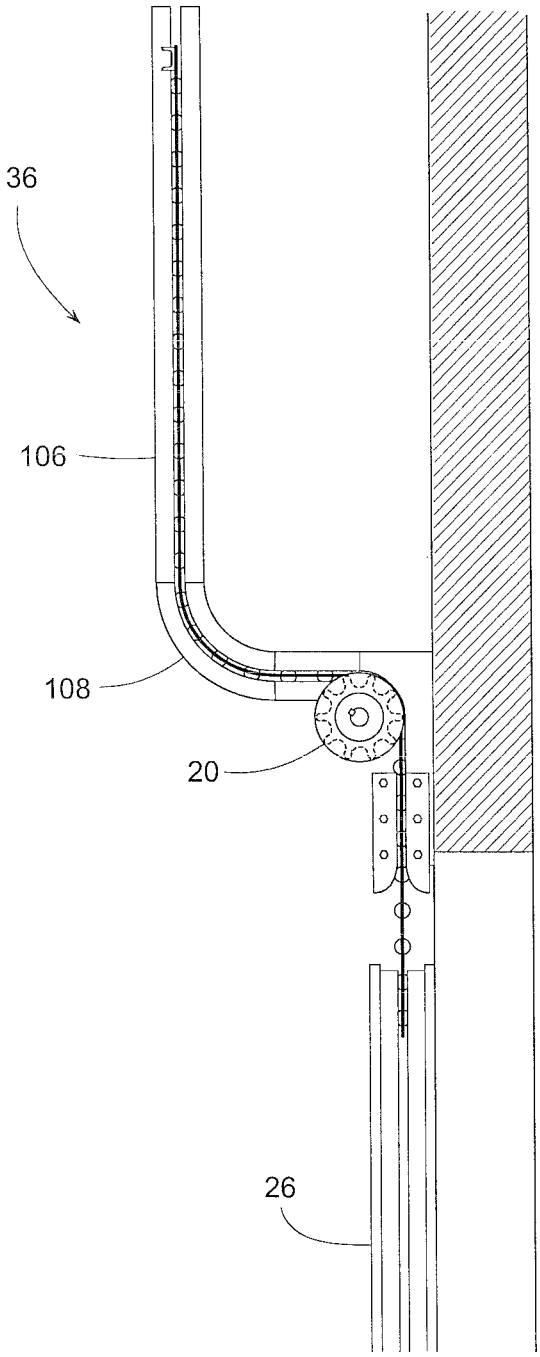
FIG. 16 is a cross-sectional view similar to FIG. 5 but showing a different storage track configuration.
Figure 17:
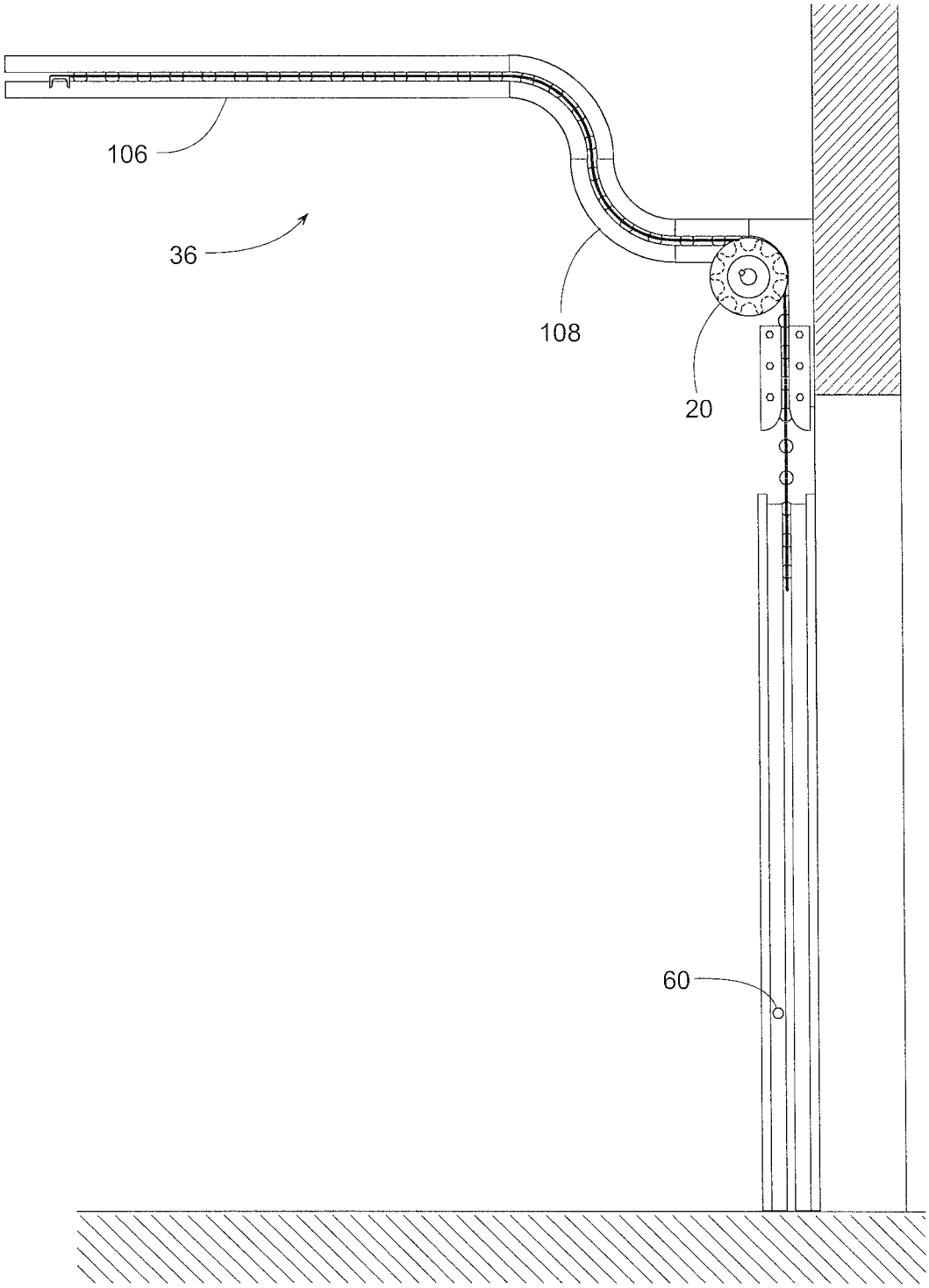
FIG. 17 is a cross-sectional view similar to FIGS. 5 and 16 but showing yet another storage track configuration.

FIGS. 16 and 17 show how different track segments 106 and 108 can be selectively arranged to create various storage track configurations. Countless other shapes of track segments and assembly configurations are well within the scope of the disclosure, including at least those shown in previously-mentioned U.S. Pat. No. 7,028,741. In many cases, however, the storage track and drive gear are arranged so that flexible panel 12 upon moving from the closed position to the open position bends one way about drive gear 20 to ensure at least 45-degrees of positive engagement therewith and then bends an opposite way to be stored in a generally out-of-the-way location. While the embodiments of FIGS. 16 and 17 show the panel disposed between the drive gear 20 and the wall above the opening, other arrangements are possible. For example, drive gear 20 could be between the panel 12 and the wall.

When a more compact storage configuration is desired, panel 12 can be stored in the coiled arrangement of FIG. 5. The panel is shown being pushed into this configuration in FIG. 4. In this case, storage track 32 comprises a scroll retention plate 110 that defines a scroll slot 112 into which drive strip 24 extends. Referring further to FIG. 18, scroll plate 110 can be fastened to a supporting side plate 114 by way of threaded fasteners 116. In some embodiments, fastener 116 comprises a threaded screw 118 and a nut 120 that clamp a sleeve 122 between plates 110 and 114. Sleeve 122 maintains a space 124 within which projections 22 can be contained between plates 110 and 114. To reduce the frictional drag between drive strip 24 and scroll plate 110 as drive gear 20 pushes strip 24 into storage track 32, slot 112 near an open-air central region 126 is wider than slot 112 near an outer periphery 128 of scroll plate 110 (compare dimensions 130 and 132).

Figure 5A:
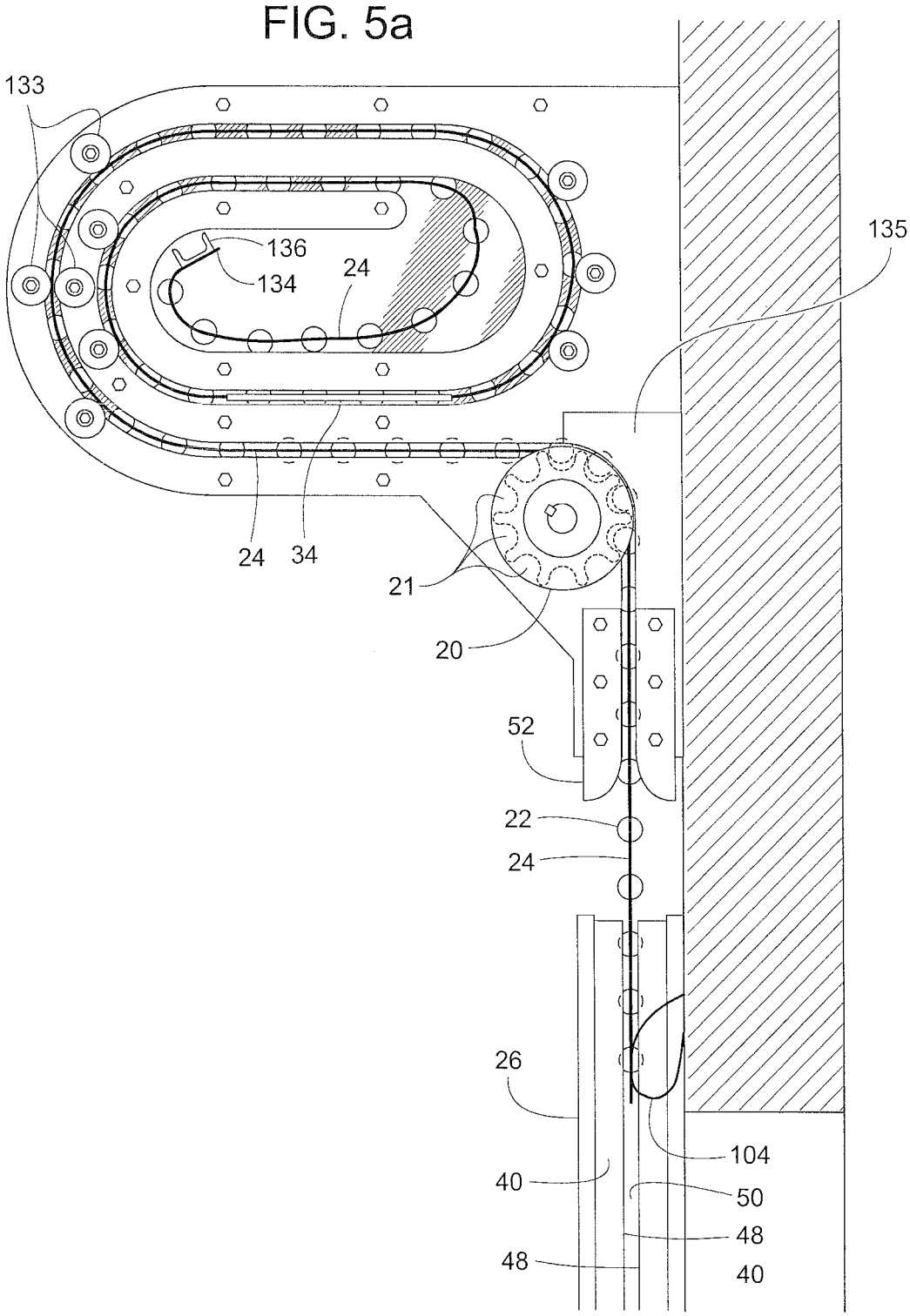
FIG. 5*a* is similar to FIG. 5, but showing additional inventive features.

A modification to further address the issue of friction in operation of a door as depicted in the drawings is shown in FIG. 5*a*. Here, free-wheeling rollers 133 are added adjacent to the scroll slot 112 of FIG. 4. These rollers not only provide less friction to the passing panel or drive strip as compared to contact of the panel or drive strip with the slot 112, but may also hold the panel and/or its drive strip separated from the surface of slot 112.

The employment of such free-wheeling rollers to reduce friction may also be desirable in other areas of the door. The embodiments shown herein, for example, depict a bearing guide 135 adjacent drive gear 20 (FIG. 5*a*). This bearing guide has a radiused interior complementary in dimension to the drive gear 20, and is disposed at a small gap from gear 20 through which panel 12 passes. Accordingly, bearing guide 135 helps hold projections 22 in contact with grooves 21 in drive gear 20 as panel 12 including drive strip 24 passes by. To still allow for this action, but to reduce overall friction, it may be desirable, as shown in FIG. 21 to included free-wheeling rollers 233 similar to rollers 133 on, adjacent, and/or instead of the bearing guide 135 to achieve similar benefits to employing rollers elsewhere. In this example, the free wheeling rollers 233 are located on the bearing guide 135 and help transfer the frictional load from the projections 22 (e.g., a point or line load) to the drive strip 24 (e.g., a planar load), thereby assisting in reducing the wear on the projections 22 and/or on the bearing guide 135 by reducing the frequency of contact between the projections 22 and the bearing guide 135. Specifically, the rollers 233 tend to counteract the centripetal forces that throw the projections 22 into contact with the bearing guide 135 during high speed operations.

FIG. 21 illustrates another example of a coiled arrangement similar to FIG. 5. In this example, the storage track 32 similarly comprises the scroll retention plate 110, defining the scroll slot 112 into which the drive strip 24 extends, but further includes a panel guide 210 to assist in directing the coiling of the door panel 12 into the coiled arrangement. In this embodiment, the panel guide 210 transfers the frictional load from the drive strip 24 to the projections 22.

Figure 22:
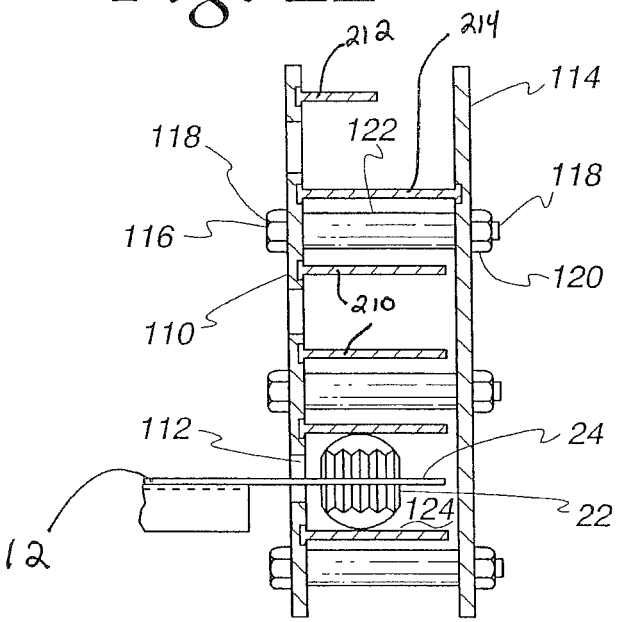
FIG. 22 is a cross-sectional view taken along line 22-22 of FIG. 21.

In particular, referring to FIG. 22, the scroll plate 110 can be fastened to the supporting side plate 114 by way of threaded fasteners 116 as described above. In this example, to reduce the frictional drag between the drive strip 24 and the scroll plate 110, the panel guide 210 extends at least partially between the scroll plate 110 and the supporting side plate 114, and is spaced such that the projections 22 contact the surfaces of the panel guide 210 before the strip 24 engages the edge of the slot 112, when the door panel 12 is substantially perpendicular to the scroll plate 110. The frictional load between the door panel 12 and the storage track 32 is thus reduced to a generally point or line load (i.e., the point or line of contact during movement between the projections 22 and the panel guide 210). Additionally, with the reduced frictional loads the length of the slot 112 may be increased thereby reducing the dimension 132, and possibly reducing the overall space requirement for the storage track 32. The panel guide 210 may be made of various materials including, but not limited to, a UHMW Polyethylene, polypropylene, nylon, stainless steel, etc.

As further illustrated in FIG. 22 the panel guide 210 may extend partially across the gap between the scroll plate 110 and the supporting side plate 114, or alternatively may extend fully across the gap. For example, one alternative panel guide 212 extends only partially (approximately half way) across the gap, while another alternative panel guide 214 extends completely across the gap. By varying the width of the panel guide, the acoustic characteristics of the door 10 in operation may be significantly varied. In each example, the panel guides 210, 212, 214 may be attached to the respective scroll plate 110 and/or supporting side plate 114 by any suitable fashion, including a friction fitting (e.g., inserting into a formed channel or slot), gluing, molding, fastening, etc.

Figure 23:
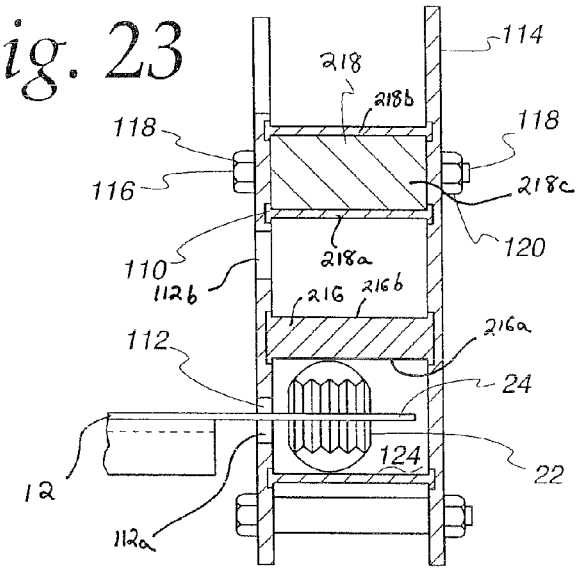
FIG. 23 is a cross-sectional view of an alternative embodiment of the cross sectional view of FIG. 22.

Other modifications to the panel guide 210 are illustrated in FIG. 23. In one modification, a panel guide 216 is thickened such that a single panel guide is utilized to contact the projections 22 as the door panel travels to adjacent slots 112*a* and 112*b*. In particular, as the door panel travels in slot 112*a*, one surface of the projection 22 contacts a first surface 216*a* of the guide 216, while when the door panel travels in slot 112*b*, one surface of the projection 22 while contact a second surface 216*b* of the same guide 216. Another alternative panel guide 218 comprises a first panel guide 218*a*, a second panel guide 218*b*, and fill material 218*c* disposed between the guides 218*a* 218*b*. The fill material 218*c* may be the same material as the panel guides 218*a*, 218*b*, or may alternatively be a different material, such as foam, etc. In each of these examples illustrated in FIG. 23. the noise associated with operating the door 10 may be reduced through the use of the thickened guides. Additionally, the strength and/or durability of the scroll track 32 assembly may be increased due to the thickened panel guide 216 and/or the fill material 218*c*.

In some instances, it may not be possible or practical to reduce the frictional load on the system. In such instances, other techniques can be employed to address the issue. For example, a panel 12 stored in the spiral configuration of FIGS. 4/5 may generate significant friction as it coils up. Portions of the panel (particularly near the bottom thereof) are not as coiled, or remain generally flat even when the panel is coiled (such as the section of the panel just past drive gear 20 in FIG. 5). In such areas of the door, it may be desirable to have drive strip 24 have greater thickness (illustratively double thickness) to allow it to transmit a greater thrust force without buckling—thus allowing higher portions of the panel to be pushed into the spiral storage configuration even with a large frictional load. These techniques for minimizing or addressing friction are applicable to other storage configurations as well.

Panel 12 being stored in a loosely coiled arrangement, as shown in FIG. 5, not only helps prevent condensation from being trapped between adjacent wraps, but the spaced-apart wraps helps prevent window 34 from being scratched by proximal facing surfaces of panel 12.

To prevent centrifugal force from creating a whipping action at an upper edge 134 of panel 12 as panel 12 rapidly wraps into scroll track 32, a stiffener 136 can be attached to edge 134. Stiffener 136 is any member that is more rigid than panel 12. Examples of stiffener 136 include, but are not limited to, a metal or plastic channel member, angle member, bar, etc.

To help prevent panel 12 from sagging near the top of the doorway, a rotatable drum 138 (FIG. 1) or roller can be disposed along a rotational axis 140 of drive gear 20. In one example, drum 138 is installed between two laterally disposed drive gears 20, wherein drum 138 and the two drive gears 20 rotate as a unit. To help protect the exposed surfaces of drum 138 and panel 12 from wear, drum 138 can be covered. In one embodiment, it is covered with a material that is substantially the same as panel 12, although a wide variety of fabric materials or other coating could be used. For appearance and to prevent rubbing surfaces from marring or discoloring each other, the exposed surfaces of drum 138 and panel 12 may be the same color.

Although in the aforementioned examples, drive strip 24 provides the dual purpose of carrying projections 22 (which are driven by the drive gear) and transmitting the drive force directly to panel 12, there are advantages to separating these two functions so that they can be performed by two different elements. The two elements, such as a drive strip 302 and a reinforcing strip 306 of FIGS. 26 and 28, can then be individually customized to most effectively handle their particular function.

Drive strip 302, for instance, needs be able to fully recover from localized bending and withstand tearing forces that can occur during driven panel movement and/or when a panel 12' is subject to impact or high wind loads that tend to forcibly and sometimes violently pull projections 22 out from within its track. Thus drive strip 302 needs a great deal of flexibility and strength. To provide such material qualities, drive strip 302 can be made of a urethane fabric or some other comparably strong, flexible material. The flexibility of the fabric has also been shown to make the operation of the door quieter, as compared to the previous examples herein. For additional strength, drive strip 302 can be made thicker than the material thickness of panel 12'. A mesh embedded within the fabric can provide drive strip 302 with even greater strength and tear resistance. Such tear resistance may be particularly advantageous in a situation, as here, where projections 22 are inserted through holes in strip 302 and are subject to significant forces upon door breakaway.

Drive strip 302 can be coupled in any suitable manner to a lateral edge 304 of panel 12'. Projections 22 can be attached to drive strip 302 in a manner similar to that shown in FIG. 10.

Figure 26:
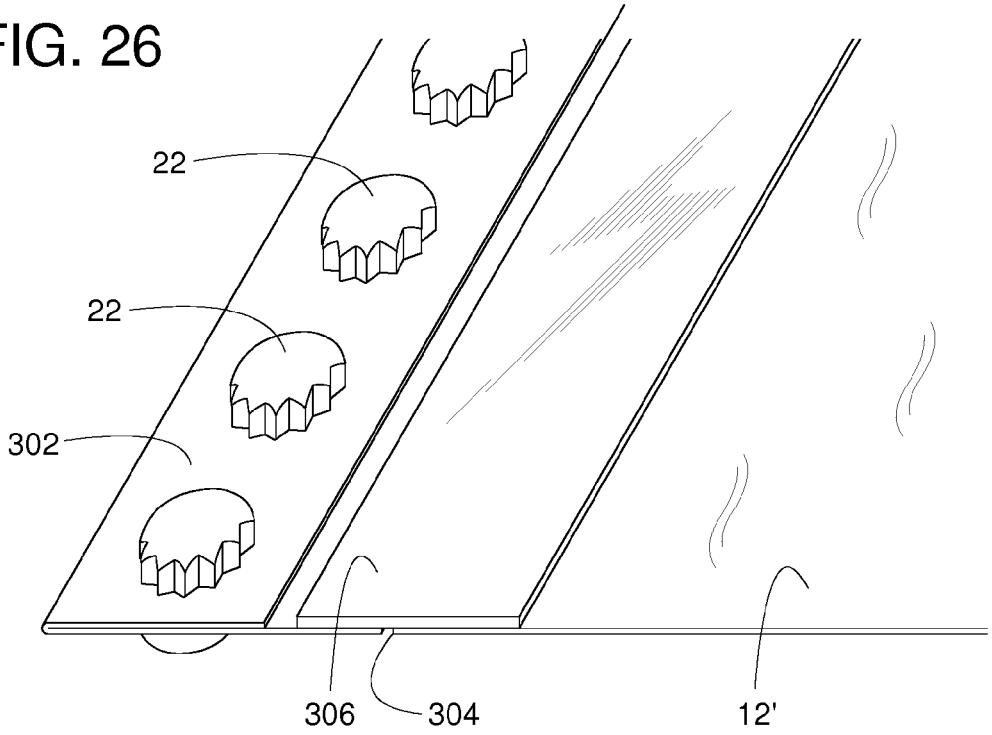
FIG. 26 is a perspective view similar to FIG. 13 but showing another embodiment.
Figure 27:
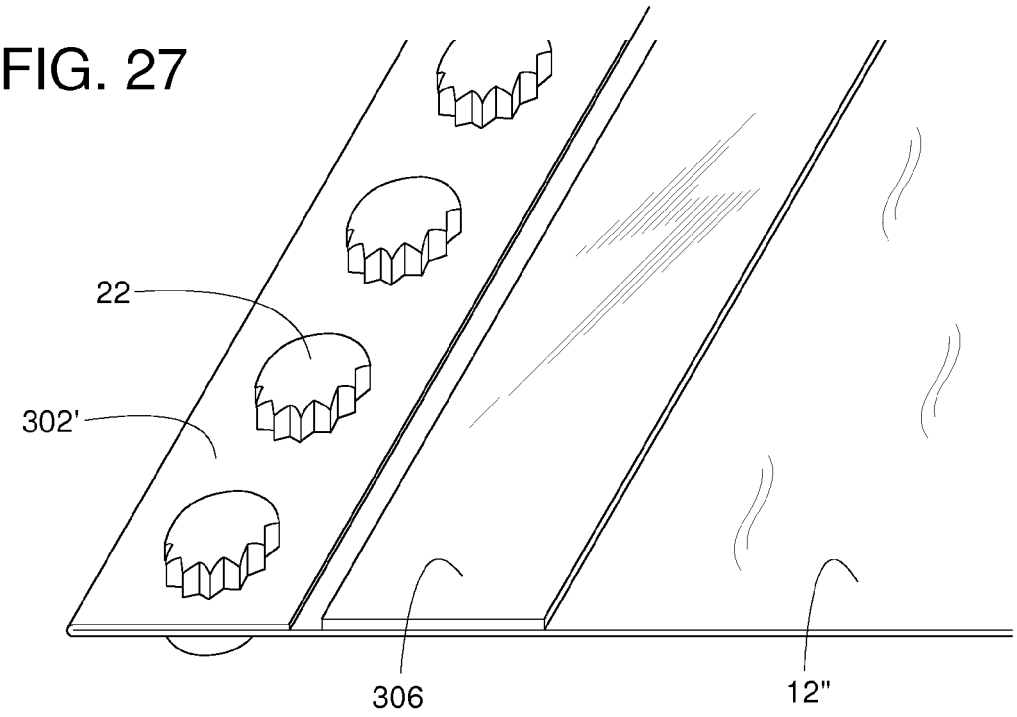
FIG. 27 is a perspective view similar to FIG. 26 but showing yet another embodiment.
Figure 28:
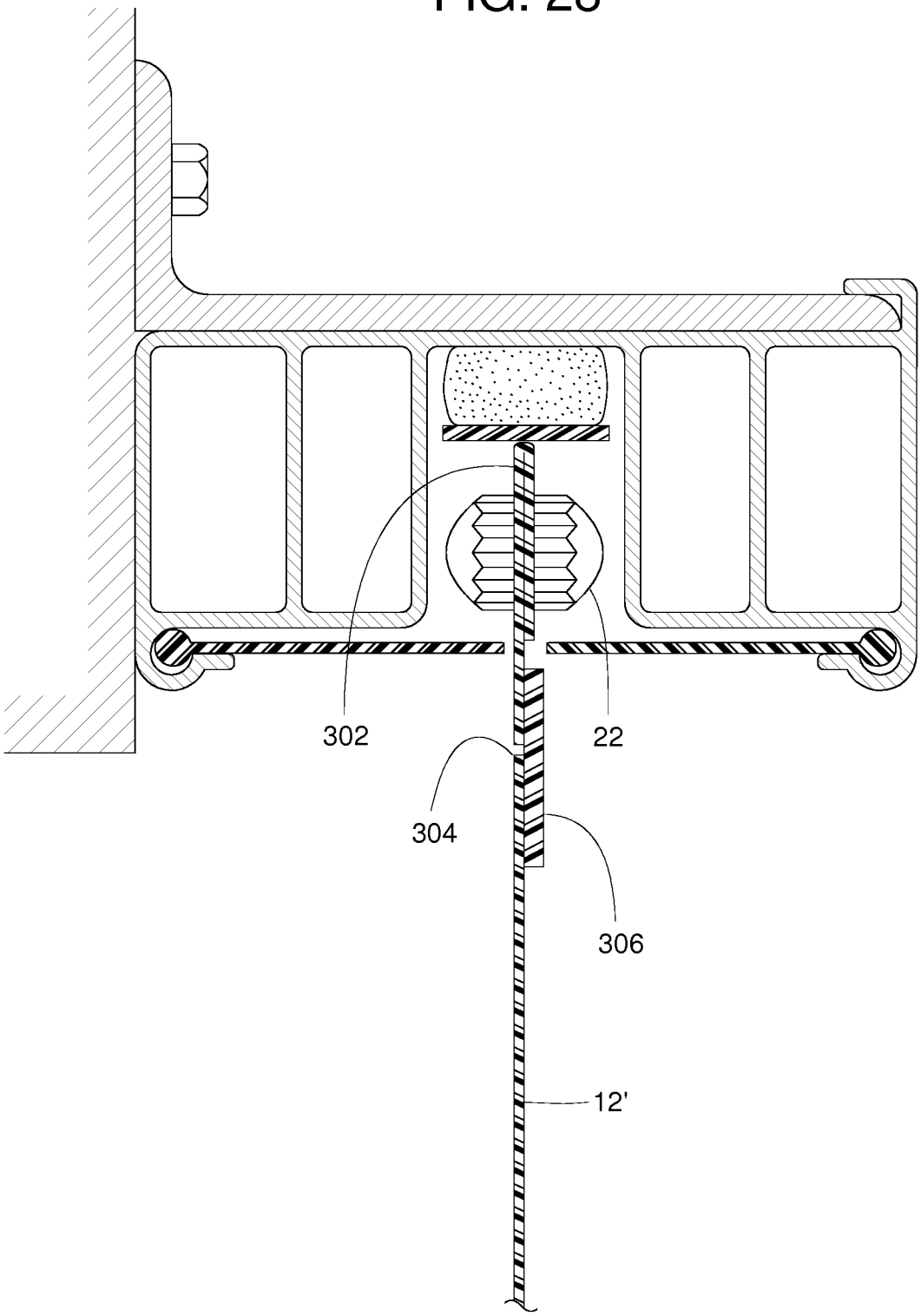
FIG. 28 is a cross-sectional view similar to FIG. 6 but showing the embodiment of FIG. 26.
Figure 29:
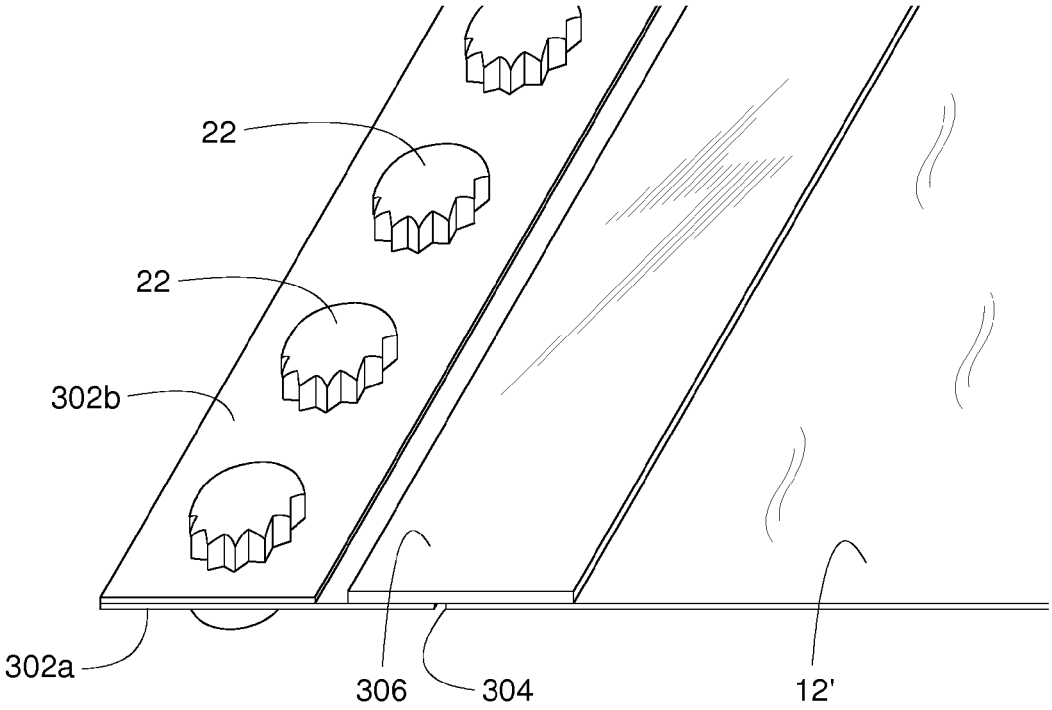
FIG. 29 is a perspective view similar to FIG. 26 but showing another embodiment.
Figure 30:
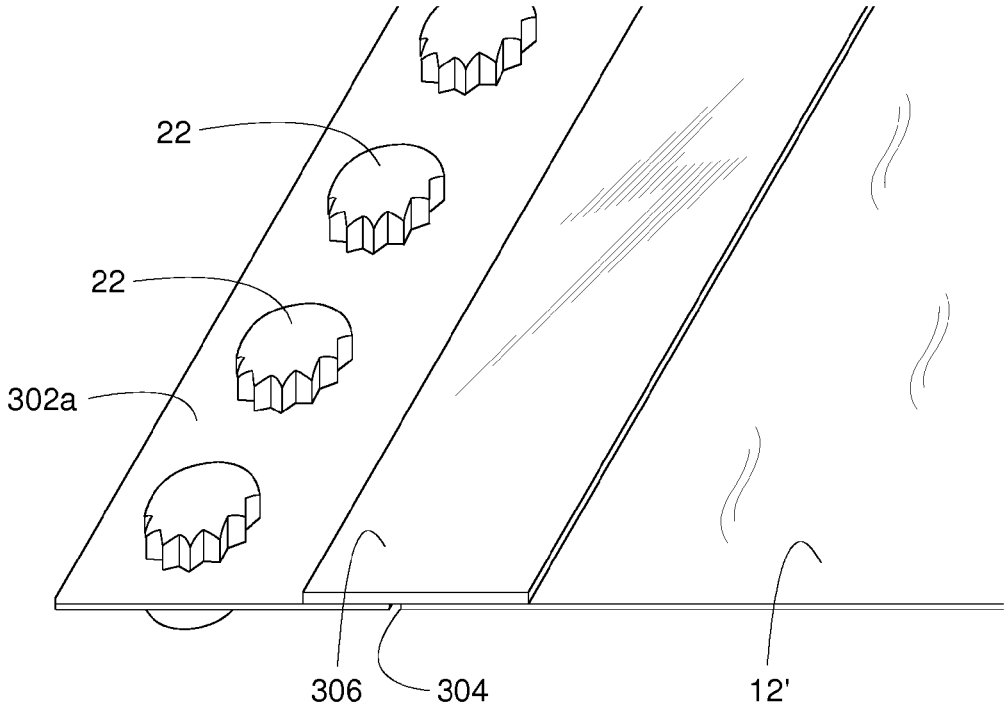
FIG. 30 is a perspective view similar to FIG. 26 but showing yet another embodiment.

The actual construction of the drive strip may vary. In FIGS. 26 and 28, for example, drive strip 302 is shown folded over onto itself for a double layer of thickness. In the example of FIG. 27, a drive strip 302' is an integral extension of a panel 12". FIG. 29 shows a drive strip comprising two individual layers 302*a* and 302*b* that are thermally bonded to each other. FIG. 30 shows the drive strip comprising just the single layer 302*a*.

If a drive strip is made relatively thick or stiff in order for it alone to transmit the force that pushes the door panel open or closed, such properties can make the drive strip too rigid to handle localized bending and might even make the drive strip more brittle and less tear resistant. Thus, the transmission of force to push panel 12' open and closed may be better handled by the addition of reinforcing strip 306, which can be specifically designed for that purpose.

Reinforcing strip 306 is disposed in the general proximity of drive strip 302 (relative to drive strip 302, the reinforcing strip 306 in this example is shown is inboard and more toward the door centerline, but other orientations are possible). Reinforcing strip 306 may illustratively be spaced a short distance (e.g., approximately one inch or less) from protrusions 22 so that drive strip 302 can provide a flexible connection between reinforcing strip 306 and protrusions 22. To effectively transmit the driving force to panel 12' without reinforcing strip 306 buckling, reinforcing strip 306 has greater resistance to lengthwise compression than does drive strip 302. Although reinforcing strip 306 is stiffer than drive strip 302 and panel

12', reinforcing strip 306 still has sufficient flexibility to bend and follow various track geometries. Reinforcing strip 306 can be made of various materials including, but not limited to, a copolymer polypropylene. Panel 12', drive strip 302, and reinforcing strip 306 can be assembled using various methods including, but not limited to, sewing, gluing, thermal bonding, riveting, etc.

Although the invention is described with respect to various embodiments, modifications thereto will be apparent to those of ordinary skill in the art. The scope of the invention, therefore, is to be determined by reference to the following claims.

What is claimed is:

1. A door system, comprising:

a track defining a channel;

a door, comprising:

a panel to be movable between an open position and a closed position, wherein the panel includes a lateral edge adjacent the track when the panel is in the closed position;

a first material coupled to the lateral edge of the panel and extending from within the channel to outside the channel toward a center of the panel when the panel is in the closed position, wherein the first material is non-separably coupled to the lateral edge of the panel, the first material unitarily formed to extend substantially a length of the lateral edge of the panel;

a plurality of projections disposed along the first material such that the plurality of projections are positioned within the channel when the panel is in the closed position, wherein one or more of the plurality of projections engages a portion of the channel when the panel is in the closed position to retain the plurality of projections within the channel, at least a portion of the first material and one or more of the projections exiting the channel when a force greater than a threshold force acts upon the door; and a second material attached to the panel, the second material extending in a lengthwise direction generally parallel to the track when the panel is in the closed position, the second material unitarily formed to extend substantially the length of the lateral edge of the panel; and a drive mechanism to engage one or more of the projections without extending through the door to move the panel between the closed position and the open position, wherein the second material is to transmit a majority of a transmission force to move the panel between the closed position and the open position.

2. The door system of claim 1, wherein the first material comprises a fabric.

3. The door system of claim 1, wherein the first material is spaced-apart from and coupled to the panel via the second material.

4. The door system of claim 1, wherein the second material is stiffer than the first material and has an increased resistance to lengthwise compression near the lateral edge.

5. The door system of claim 1, wherein the second material is spaced-apart from the plurality of projections.

6. The door system of claim 1, wherein the second material is outside the channel.

7. The door system of claim 1, wherein the first material is thicker than the panel.

8. The door system of claim 1, wherein the second material is stiffer than the first material.

9. The door system of claim 1, wherein the second material comprises a copolymer polypropylene.

10. The door system of claim 1, wherein the first material comprises an integral extension of the panel.

11. The door system of claim 1, wherein one or more of the projections comprises a first portion and a second portion, the first portion comprising an elongated member to extend through the drive material and to be received by the second portion to couple the one or more projections to the drive material.

12. The door system of claim 1, wherein one or more of the projections comprises a first portion and a second portion, at least one of the first portion or the second portion comprises a lateral surface structure to facilitate coupling the projection to the drive material.

* * * * *